US009246290B1

(12) United States Patent
Hui et al.

(10) Patent No.: US 9,246,290 B1
(45) Date of Patent: Jan. 26, 2016

(54) SWIVEL CORD-CONNECTOR

(71) Applicant: ALL GOOD INC., LIMITED, Hong Kong (CN)

(72) Inventors: Wing-tak Hui, Hong Kong (CN); Andrew Matthew Hui, San Jose, CA (US); Wing-kin Hui, Hong Kong (CN)

(73) Assignee: DONGGUAN SMARTPOOL PRODWCTS INCORPORATED CO LTD, Dongguan, Guangdong (CN)

( * ) Notice: Subject to any disclaimer, the term of this patent is extended or adjusted under 35 U.S.C. 154(b) by 0 days.

(21) Appl. No.: 14/331,164

(22) Filed: Jul. 14, 2014

(51) Int. Cl.
*H01R 39/00* (2006.01)
*H01R 39/64* (2006.01)

(52) U.S. Cl.
CPC ..... *H01R 39/64* (2013.01); *H01R 39/00* (2013.01)

(58) Field of Classification Search
CPC ..... H01R 39/64
USPC ..... 174/74 R, 75 R, 75 C, 82; 439/21–30
See application file for complete search history.

(56) References Cited

U.S. PATENT DOCUMENTS

| | | | | |
|---|---|---|---|---|
| 5,468,912 | A | 11/1995 | Zalewski | |
| 6,412,133 | B1 * | 7/2002 | Erlich et al. | 15/1.7 |
| 6,448,494 | B1 | 9/2002 | Erlich et al. | |
| 6,935,046 | B2 | 8/2005 | Tang et al. | |
| 8,215,962 | B1 | 7/2012 | Machado | |
| 2006/0223394 | A1 * | 10/2006 | Porat | 441/136 |
| 2014/0273540 | A1 | 9/2014 | Brown | |
| 2014/0273541 | A1 | 9/2014 | Renaud et al. | |

* cited by examiner

*Primary Examiner* — James Harvey
(74) *Attorney, Agent, or Firm* — David Lewis; Bowen Liu

(57) ABSTRACT

A swivel cord-connector having a swivel head and a swivel tail connected via a swivel core. In an embodiment, a head assembly of the swivel core is enclosed in the swivel head and a tail assembly of the swivel core is enclosed in the swivel tail. In an embodiment, the swivel core includes at least a central conductor rod and one or more concentric conductor tubes, which may rotate along the longitudinal axis. In an embodiment, the swivel head has an asymmetrical structure for providing counter torque forces. In an embodiment, the swivel is waterproof and/or can float on water surface.

26 Claims, 18 Drawing Sheets

300b

SWIVEL CORD-CONNECTOR

FIELD

This specification generally relates to power cords.

BACKGROUND

The subject matter discussed in the background section should not be assumed to be prior art merely as a result of its mention in the background section. Similarly, a problem and the understanding of the causes of a problem mentioned in the background section or associated with the subject matter of the background section should not be assumed to have been previously recognized in the prior art. The subject matter in the background section may merely represent different approaches, which in and of themselves may also be inventions.

This specification recognizes that problems occur as a result of cords twisting or coiling. A cord has a tendency to twist, especially a long cord. As the twists or coils are formed, the twists and coils have the effect of reducing the ability of the cord to extend the full length of the cord and/or interrupting the intended movement as is required under many circumstances.

BRIEF DESCRIPTION OF THE FIGURES

In the following drawings like reference numbers are used to refer to like elements. Although the following figures depict various examples of the invention, the invention is not limited to the examples depicted in the figures.

DETAILED DESCRIPTION

Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

In general, at the beginning of the discussion of each of FIGS. 1A-5 is a brief description of each element, which may have no more than the name of each of the elements in the one of FIGS. 1A-5 that is being discussed. After the brief description of each element, each element is further discussed in numerical order. In general, each of FIGS. 1A-9 is discussed in numerical order and the elements within FIGS. 1A-9 are also usually discussed in numerical order to facilitate easily locating the discussion of a particular element. Nonetheless, there is no one location where all of the information of any element of FIGS. 1A-9 is necessarily located. Unique information about any particular element or any other aspect of any of FIGS. 1A-9 may be found in, or implied by, any part of the specification.

In various places in discussing the drawings a range of letters, such as a-n are used to refer to individual elements of various series of elements that are the same. In each of these series, the ending letters are integer variables that can be any number. Unless indicated otherwise, the number of elements in each of these series is unrelated to the number of elements in others of these series. Specifically, even though one letter (e.g. "c") comes earlier in the alphabet than another letter (e.g., "n"), the order of these letters in the alphabet does not mean that the earlier letter represents a smaller number. The value of the earlier letter is unrelated to the later letter, and may represent a value that is greater the same or less than the later letter.

Figure 1A:
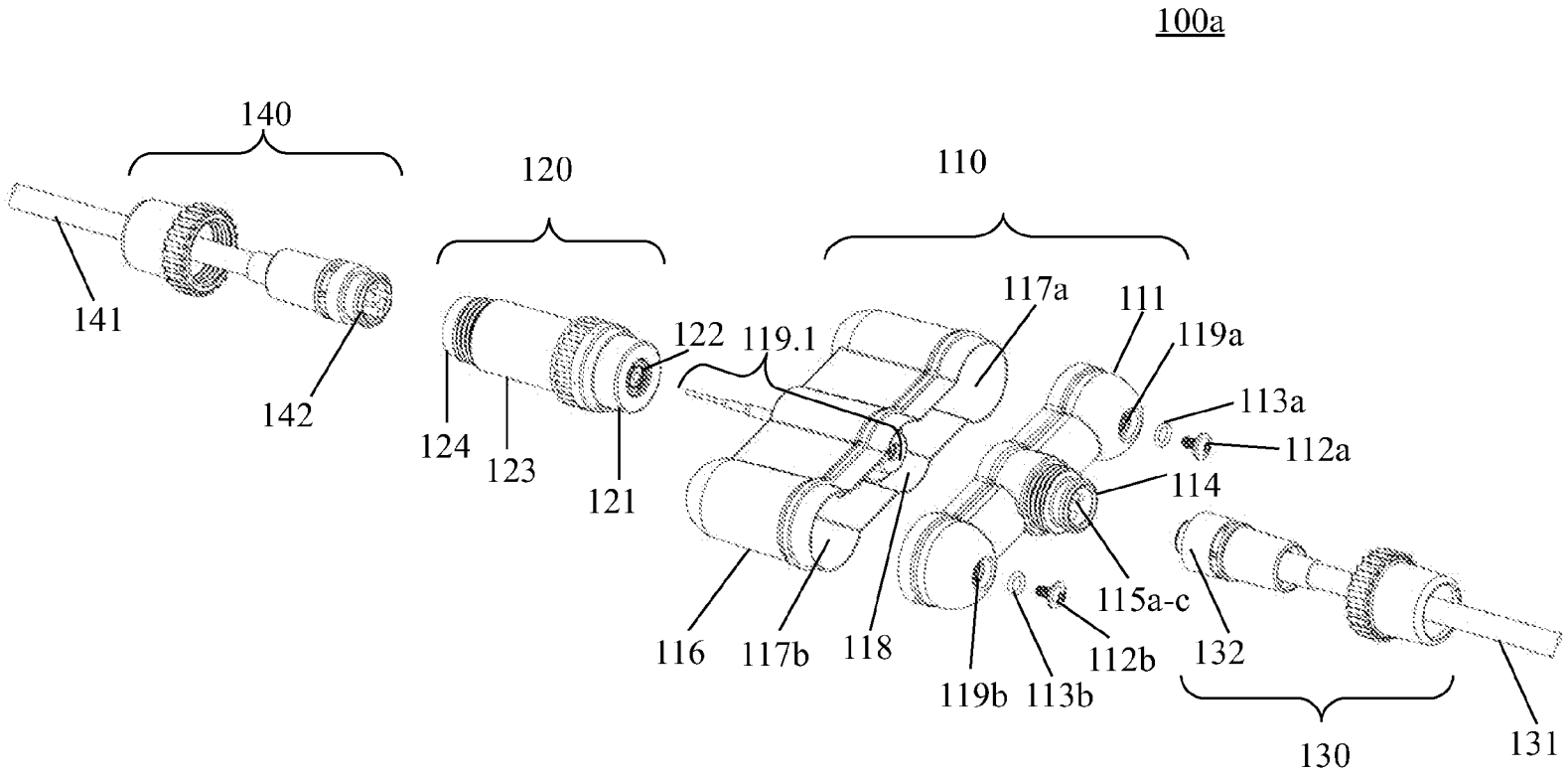
FIG. 1A shows a partially exploded view, as an overview of an embodiment of a swivel cord-connector.

FIG. 1A shows an overview of an embodiment of a swivel cord-connector 100*a*. The swivel cord-connector 100*a* may include a swivel head 110, which includes at least a swivel head cover 111, a pair of screws 112*a* and 112*b*, a pair of o-rings 113*a* and 113*b*, an electrical plug 114, three plug pins 115*a-c*, a swivel head container 116, a pair of side chambers 117*a* and 117*b*, a middle chamber 118, and two drain ports 119*a* and 119*b*. The swivel head 110 may also include a swivel core head assembly 119.1. The swivel cord-connector 100*a* may further include a swivel tail 120, which includes at least a swivel tail cover 121, an opening 122, a swivel tail container 123, and an electrical socket 124. FIG. 1A also shows an electrical connector 130, a power cable 131, an electrical socket 132, an electrical connector 140, a power cord 141, and an electrical plug 142. In other embodiments, swivel cord-connector 100*a* may not have all of the elements or features listed and/or may have other elements or features instead of or in addition to those listed.

Swivel cord-connector 100*a* serves to uncoil a twisted cord and/or prevent the twisting from passing to the rest of the cord, while still maintain continuity of electricity. In at least one embodiment, swivel cord-connector 100*a* is water tight and may be used in a pool or other body of water. In at least one embodiment, the swivel cord-connector 100*a* includes a swivel head and a swivel tail, which are connected via a swivel core that allows the swivel head and swivel tail to rotate with respect to each other. In at least one embodiment, the swivel head is connected to a power outlet, via a power cable, while the swivel tail is connected to a device or apparatus, via a cord. The device or apparatus causes the cord to twist and/or coil during use. In at least one embodiment, the swivel head of swivel cord-connector 100*a* has an asymmetrical structure that provides counter-torque forces to prevent the swivel head from spinning when the core swivel 100*a* is placed on a surface (e.g., a water surface, a ground surface, a table surface, a concrete surface, etc.), while the swivel tail rotates to untwist the cord that is further connected to the device or apparatus. In at least one embodiment, the swivel cord-connector 100*a* prevents twisting from passing from the cord that is connected to the swivel tail to the power cable that is connected to the swivel head. In another embodiment, the swivel head has a symmetrical structure, which may or may not provide counter-torque forces. In at least one embodiment, the swivel head and swivel tail have similar or identical shapes, and/or may rotate freely with respect to each other. In at least one embodiment, the swivel cord-connector 100*a* is waterproof. In one embodiment, the swivel cord-connector 100*a* has an average density that is less than water, thus can float on the water. Throughout this specification, the terms "cord," "cable," and "wire" may be substituted one for the other to obtain different embodiments. Throughout this specification, the terms "container," "enclosure," and "chamber" may be substituted one for the other to obtain different embodiments.

Swivel head 110 is a structure including a head assembly of a swivel core enclosed in a watertight chamber. In at least one embodiment, the swivel head 110 has an asymmetrical structure, such as a double barrel wing, for providing counter-torque forces when placed on a surface to prevent the swivel head 110 from spinning. In at least one embodiment, the double barrel wing structure of the swivel head 110 includes a cylindrical middle chamber for enclosing a head assembly of a swivel core along the longitudinal axis of the middle chamber, while the swivel core protrudes out of the swivel head and is further enclosed in a swivel tail, with a tail assembly of the swivel core tightly affixed in the swivel tail. In at least one embodiment, the swivel head 110 also includes two barrel shaped side chambers in parallel with the middle chamber, one at each end of the wing structure (which may also be referred to as a double-barrel wing). In at least one embodiment, the asymmetrical structure of swivel head 110 is detachable, and/or can be attached to the swivel head 110 or a cord which does not cause twisting or is not desired to rotate. For example, the asymmetrical structure can be attached to the power cable that connects the swivel head 110 to the power outlet. In at least one embodiment, the swivel head 110 includes an electrical plug that is electrically connected to the head assembly of the swivel core. In at least one embodiment, swivel head 110 includes drain ports to drain water out of the swivel head 110, in case water gets into the swivel head 110 during use. In other embodiments, the swivel head 110 may have other asymmetric structures, such as a delta wing.

Although an asymmetrical structure of swivel head 110 is described in some embodiments, it should be appreciated that in other embodiments swivel head 110 may have symmetrical structures (e.g., a cube), or have symmetrical cross sections (e.g., a square cross section, an equilateral triangular cross section etc.), which may also provide friction (or fluid resistance) creating a counter-torque that hinders the swivel head from spinning when the core swivel 100*a* is placed on a surface. Any noncylindrical cross section may be used, as long as sufficient frictional forces are created to resist rotation. The swivel head may additionally or alternatively include one or more fins to create fluid resistance, hindering (e.g., preventing) the rotation of the swivel head. In another embodiment, the swivel head has symmetrical structures, such as a cylindrical structure or a ball shaped structure, which may not provide counter-torque forces. In some embodiments, the swivel head 110 may rotate freely with respect to the swivel tail. In at least one embodiment, the structures of swivel head and swivel tail are similar or identical. In at least one embodiment, the swivel head 110 and swivel tail are both cylindrical shaped and may rotate freely with respect to each other. In other embodiments, the swivel head 110 may have other shapes.

In at least one embodiment, swivel head 110 includes at least a swivel head cover 111, a pair of screws 112*a* and 112*b*, a pair of o-rings 113*a* and 113*b*, an electrical plug 114, three plug pins 115*a-c*, a swivel head container 116, a pair of side chambers 117*a* and 117*b*, a middle chamber 118, two drain ports 119*a* and 119*b*. Swivel head 110 may further includes a swivel core head assembly 119.1. In other embodiments, swivel head 110 may not have all of the elements or features listed and/or may have other elements or features instead of or in addition to those listed.

Swivel head cover 111 is a cover that engages with a swivel head container to form the chamber of the swivel head 110. In at least one embodiment, the swivel head cover 111 includes an electrical plug in the middle that is part of the middle chamber when engaged with the swivel head container, which electrical plug includes electrical plug pins facing away from the swivel head container. In at least one embodiment, the swivel head cover 111 also includes two drain ports, one at the head of each side chamber of swivel head 110. In at least one embodiment, the swivel head cover 111 is tightly attached to the swivel head container and the drain ports are sealed using o-rings and screws to form a watertight container that encloses the head assembly of the swivel core during use of the swivel cord-connector 100*a*.

Screws 112*a* and 112*b* are two screws for the two drain ports on the swivel head cover 111 for sealing the drain ports. In at least one embodiment, either screws 112*a* or 112*be* may be removed to drain water out of the swivel head 110. In at least one embodiment, a pair of o-rings may be used along with screws 112*a* and 112*b* to provide a watertight seal. In other embodiments, other numbers of drain ports and/or screws may be used.

O-rings 113*a* and 113*b* are a pair of circular loops of elastomer placed in-between screws 112*a* and 112*b* and drain ports on swivel head cover 111, thus providing a watertight seal when the screws 112*a* and 112*b* are tightly screwed to the drain ports. In one embodiment, the o-rings 113*a* and 113*b* are made of rubber, silicon, or other soft water tight materials.

Electrical plug 114 is an electrical plug structure at the middle of the swivel head cover 111, for connecting the swivel head 110 to an electrical cable or cord. In at least one embodiment, the electrical plug 114 includes three electrical plug pins (e.g., one pin for a positive electrical line, one pin for a negative electrical line, and one pin for a ground line). In at least one embodiment, the electrical plug 114 at the swivel head cover 111 has screw threads on the outer surface of the electrical plug 114 for hermetically engaging an electrical connector to a power cable or cord. In other embodiments, the electrical plug 114 includes another number of prongs, blades, or pins. In another embodiment, other types of electrical plug or socket structures may be substituted for the electrical plug 114.

Plug pins 115*a-c* are three protruding electrical plug pins of the electrical plug 114. The plug pins 115*a-c* are made of conductive materials, such as brass, copper, aluminum, silver, gold, and/or stainless steel. In this specification, any of the conductors may be made from stainless steel, copper, aluminum, nickel, tin, or a mixture of any combination of stainless steel, brass, copper, aluminum, nickel, tin, silver, and/or gold or another conductor, with or without gold and/or silver plating instead of or in addition to any other materials mentioned elsewhere in the specification. In at least one embodiment, each of the plug pins 115*a-c* includes a portion facing the middle chamber of swivel head 110, which is rigidly connected (e.g., soldered) to an electrical wire, which in turn connects to the swivel core enclosed inside the swivel head 110. In at least one embodiment, the plug pins 115*a-c* of the electrical plug 114 may fit into matching slots or holes of a socket within an electrical connector that connects to a power cable or cord. In other embodiments, other numbers of plug pins are included in the electrical plug 114, such as two plug pins in a two-pin design (in which there is no ground line), or four plug pins in a four-pin design (which supports two electrical cords that do not have a ground cord), etc.

Swivel head container 116 encloses the head assembly of the swivel core and engages tightly with the swivel head cover 111 to form the chamber of the swivel head 110. The swivel head container 116 includes portions of the middle chamber and side chambers of the swivel head 110. In at least one embodiment, the swivel core is tightly attached inside the middle chamber of the swivel head container 116, with the tail of the swivel core protruding out through a circular opening at the bottom of swivel head container 116.

Side chambers 117*a* and 117*b* are two cylindrical chambers, one at each end of the double barrel wing of swivel head 110. The swivel head cover 111 includes top portions of both side chambers 117*a* and 117*b*, while the swivel head container 116 includes bottom portions. Side chambers 117*a* and 117*b* are connected to a middle chamber via side walls, so that to form a watertight enclosure when the swivel head cover 111 is tightly attached to the swivel head container 116.

Middle chamber 118 is a cylindrical chamber in the middle of swivel head 110 along the longitudinal axis for enclosing the head assembly of the swivel core. In at least one embodiment, the middle chamber 118 and the electrical plug 114 are concentric. In one embodiment, the middle chamber 118 has a circular opening at the bottom opposite to the swivel head cover 111 for the swivel core to go through. In at least one embodiment, the cross section of the circular opening at the bottom of middle chamber 118 is slightly greater than the outer diameter of the tail of the swivel core that goes through the circular opening. In at least one embodiment, a waterproof seal is placed in the circular opening for preventing water from coming into the swivel head 110 during use.

Drain ports 119*a* and 119*b* are two openings at the swivel head cover 111 on top of side chambers 117*a* and 117*b*. In at least one embodiment, the drain ports 119*a* and 119*b* have screw threads on the inner surface, and may be sealed using o-rings and screws during use of the swivel cord-connector 100*a*. In case water gets into the swivel head 110, either screw 112*a* or 112*b* can be removed from the drain port 119*a* or 119*b* to drain water out of swivel head 110. Optionally, other numbers of drain ports, and/or on other locations, may be included in swivel head 110 (e.g., only one drain port located anywhere on either swivel head cover 111 or swivel head container 116, etc). In other embodiments, the drain ports 119*a* and 119*b* may be plugged or sealed using other structures. In one embodiment, drain ports 119*a* and 119*b* are optional. In one embodiment, other methods and/or structures are used to drain water out of swivel head 110.

Swivel core head assembly 119.1 is an assembly of the rotating parts at a head portion of the swivel core. Swivel core head assembly 119.1 includes at least a central conductor rod, a first conductor tube, and a second conductor tube, which are co-axial and concentric. The swivel core head assembly 119.1 also includes at least a swivel core housing that encloses head ends of the concentric conductor rod and tubes along with other structures. In at least one embodiment, the swivel core head assembly 119.1 is placed into the swivel head container 116 with the swivel core housing tightly affixed inside the swivel head 110. The concentric conductor rod and tubes go through the circular opening at the bottom of the middle chamber 118 of swivel head container 116 and are further enclosed in the swivel tail 120. Swivel core head assembly 119.1 and the swivel core will be discussed further in conjunction with FIGS. 2, 7A and 7B.

Swivel tail 120 is a structure including a tail assembly of the swivel core in a watertight enclosure. In at least one embodiment, the swivel tail 120 has a symmetrical structure (e.g., a cylindrical container or a barrel), and/or may rotate freely about the longitudinal axis with respect to the swivel head 110. In at least one embodiment, the tail assembly of the swivel core is tightly affixed inside the swivel tail 120. In at least one embodiment, the swivel tail 120 is cylindrical and includes an electrical socket at the tail end of the swivel tail 120 opposite to the swivel head 110, which electrical socket is electrically connected to the tail assembly of swivel core. In other embodiments, the swivel tail 120 may have other symmetric structures.

In at least one embodiment, the swivel tail 120 includes at least a swivel tail cover 121, an opening 122, a swivel tail container 123, and an electrical socket 124. In other embodiments, swivel tail 120 may not have all of the elements or features listed and/or may have other elements or features instead of or in addition to those listed.

Swivel tail cover 121 is a cover that engages with a swivel tail container to form the watertight enclosure of the swivel tail 120. The swivel tail cover 121 includes an opening on the top for the swivel core to go through and into the swivel tail 120.

Opening 122 is a circular opening on the top of the swivel tail cover 121 opposite to the swivel tail container, through which the tail end of the swivel core goes into the swivel tail 120. In at least one embodiment, the cross section of opening 122 is slightly greater than the outer diameter of the swivel core that goes through the opening 122. In at least one embodiment, a waterproof seal is placed in the opening 122 to prevent water from coming into the swivel tail 120.

Swivel tail container 123 encloses the tail assembly of the swivel core and engages tightly with the swivel tail cover 121 to form the container of swivel tail 120. In at least one embodiment, the swivel tail container 123 is cylindrical or has other shapes. In at least one embodiment, the swivel tail container 123 includes an electrical socket at the bottom of swivel tail container 123 opposite to the swivel tail cover 121.

Electrical socket 124 is an electrical socket structure at the bottom of the swivel tail container 123 opposite to the swivel tail cover 121, for connecting the swivel tail 120 to an electrical cable or cord. In at least one embodiment, the electrical socket 124 includes three electrical socket pins. In at least one embodiment, the electrical socket 124 includes other numbers of socket pins. In at least one embodiment, the electrical socket 124 has screw threads on the outer surface of the electrical socket 124 for hermetically engaging an electrical connector to a power cord. In another embodiment, other electrical socket or electrical plug structures may be substituted for the electrical socket 124.

Electrical connector 130 connects the electrical plug 114 at the swivel head cover 111 to a power cable 131. In one embodiment, the electrical connector 130 includes an electrical socket 132 that mates with the electrical plug 114 for transmitting electricity. In another embodiment, the electrical connector 130 has other structures that connect to the swivel head 110 and transmit electricity. In at least one embodiment, the electrical connector 130 includes a waterproof seal for preventing water from getting in contact with the plug pins 115*a-c* and inner parts of the electrical connector 130. In one embodiment, the electrical connector 130 can be tightly screwed onto the swivel head 110. In at least one embodiment, the electrical connector 130 connects a power cable 131 at one end to the swivel head 110, while at the other end to a power supply, such as an AC outlet. Optionally, the electrical connector 130 is permanently attached and/or sealed to the electrical plug 114 at the swivel head 110.

Electrical connector 140 connects the electrical socket 124 at the swivel tail container 123 to a power cord 141. In one embodiment, the electrical connector 140 includes an electrical plug 142 that mates with the electrical socket 124 for transmitting electricity. In another embodiment, the electrical connector 140 has other structures that connect to the swivel tail 120 and transmit electricity. In at least one embodiment, the electrical connector 140 includes a waterproof seal for preventing water from getting in contact with socket pins of the electrical socket 124 and inner parts of the electrical connector 140. In one embodiment, the electrical connector 140 can be tightly screwed onto the swivel tail 120. In at least one embodiment, the electrical connector 140 connects a power cord 141 at one end to the swivel tail 120, while at the other end to a device or an apparatus that may cause twisting during use. Optionally the electrical connector 140 is permanently attached and/or sealed to the electrical socket 124 at the swivel tail 120.

Figure 1B:
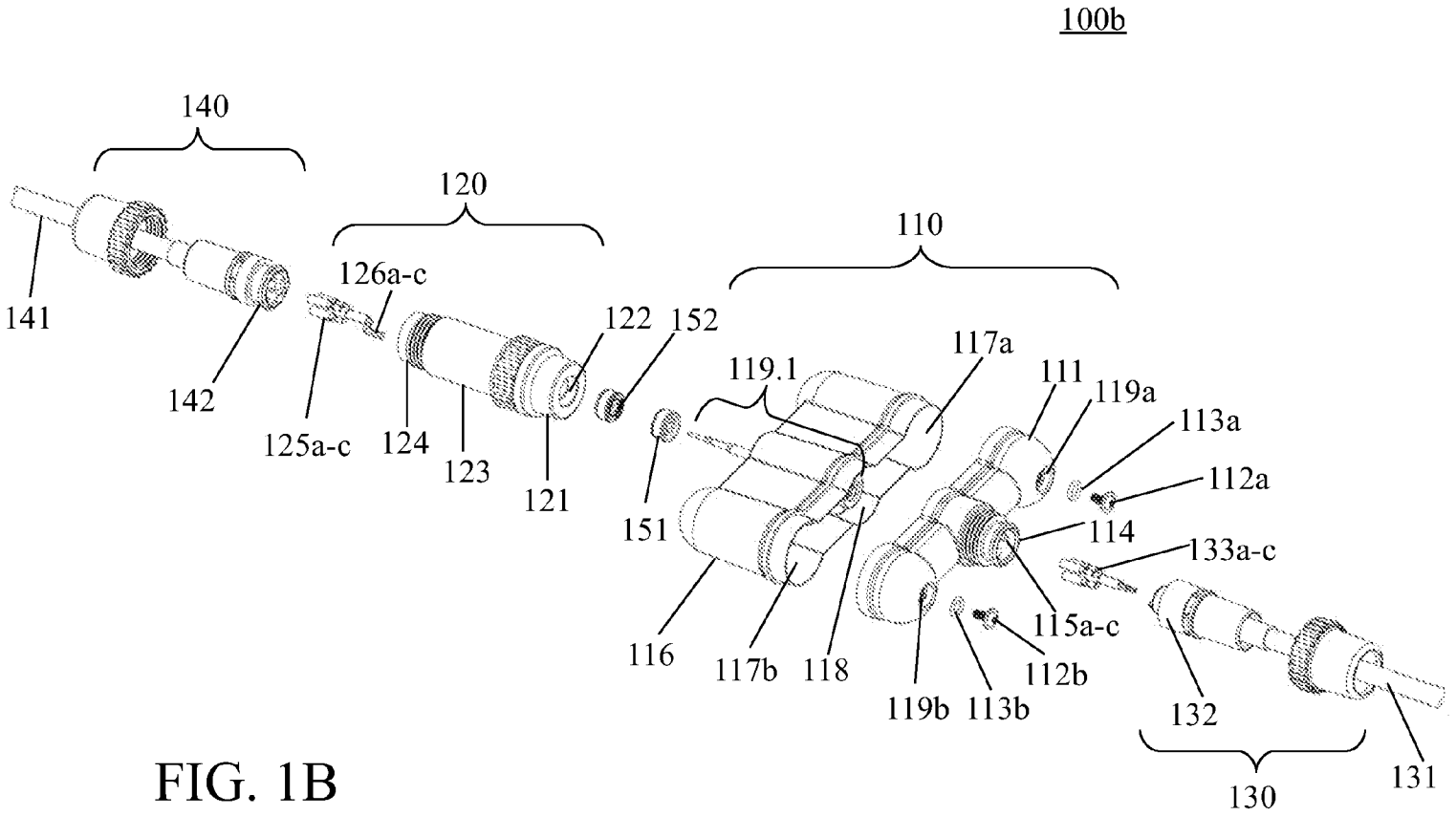
FIG. 1B shows another exploded view of an embodiment of the swivel cord-connector of FIG. 1A.

FIG. 1B shows another view 100*b* of an embodiment of the swivel cord-connector 100*a* of FIG. 1A. FIG. 1B shows at least swivel head 110, swivel head cover 111, screws 112*a* and 112*b*, o-rings 113*a* and 113*b*, electrical plug 114, plug pins 115*a-c*, swivel head container 116, side chambers 117*a* and 117*b*, middle chamber 118, drain ports 119*a* and 119*b*, swivel core head assembly 119.1, swivel tail 120, swivel tail cover 121, opening 122, swivel tail container 123, electrical socket 124, electrical connector 130, power cable 131, electrical socket 132, electrical connector 140, power cord 141, and electrical plug 142, which were discussed in conjunction with FIG. 1A. FIG. 1B also includes three socket pins 125*a-c*, three electrical wires 126*a-c*, socket pins 133*a-c*, a first waterproof seal 151, and a second waterproof seal 152. In other embodiments, FIG. 1B may not have all of the elements or features listed and/or may have other elements or features instead of or in addition to those listed.

Socket pins 125*a-c* are three socket pins of the electrical socket 124. The socket pins 125*a-c* are made of conductive materials, such as brass or stainless steel. In at least one embodiment, each of socket pins 125*a-c* is rigidly connected (e.g., soldered) to an electrical wire that further connects to the tail assembly of the swivel core. In at least one embodiment, the socket pins 125*a-c* of the electrical socket 124 may engage with plug pins of electrical plug 142 within electrical connector 140 that connects to power cable 141. In other embodiments, socket pins 125*a-c* may include other numbers of socket pins.

Electrical wires 126*a-c* are three electrical wires for connecting the socket pins 125*a-c* to the tail assembly of the swivel core.

Socket pins 133*a-c* are three socket pins of the electrical socket 132 of electrical connector 130. The socket pins 133*a-c* are made of conductive materials, such as brass or stainless steel. In at least one embodiment, the socket pins 133*a-c* are electrically connected with electrical wires in the power cable 131. In at least one embodiment, the socket pins 133*a-c* of the electrical socket 132 may engage with plug pins 115*a-c* of electrical plug 114. In other embodiments, socket pins 133*a-c* may include other numbers of socket pins.

First waterproof seal 151 is a circular waterproof ring or band, which may be made of elastomeric materials, for example, for providing a watertight seal in-between the circular opening at the bottom of the swivel head container 116 and the swivel core head assembly 119.1 that goes through the circular opening. In this specification, the words "ring" and "band" may be interchanged with one another to obtain new embodiments. The first waterproof seal 151 may be made of rubber, silicon, or other materials. In at least one embodiment, the first waterproof seal 151 provides a watertight seal and prevent water from getting into the swivel head 110, when the swivel core rotates along the longitudinal axis.

Second waterproof seal 152 is a circular waterproof ring or band made of elastomeric materials (or other watertight materials) for providing a watertight seal in-between the opening 122 at the swivel tail cover 121 and the swivel core head assembly 119.1 that goes through the opening 122. In at least one embodiment, the second waterproof seal 152 has similar shape and/or materials as the first waterproof seal 151. In at least one embodiment, the second waterproof seal 152 prevents water from getting into the swivel tail 120 during the use of swivel cord-connector 100*a*.

Figure 1C:
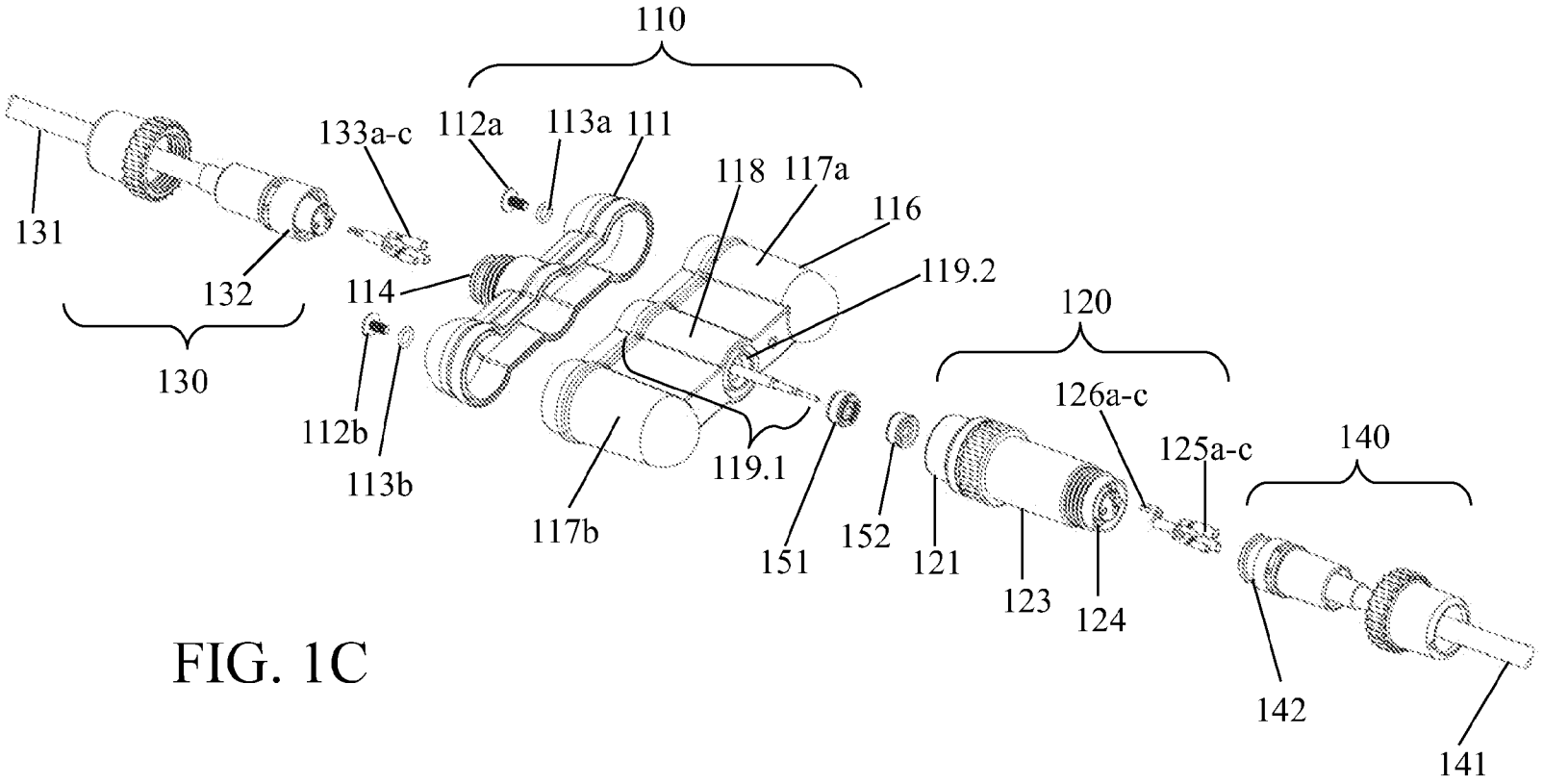
FIG. 1C shows an exploded view at another angle of FIG. 1B.

FIG. 1C shows a view 100*c* at another angle of FIG. 1B. FIG. 1C shows at least swivel head 110, swivel head cover 111, screws 112*a* and 112*b*, o-rings 113*a* and 113*b*, electrical plug 114, swivel head container 116, side chambers 117*a* and 117*b*, middle chamber 118, swivel core head assembly 119.1, swivel tail 120, swivel tail cover 121, opening 122, swivel tail container 123, electrical socket 124, electrical connector 130, power cable 131, electrical socket 132, electrical connector 140, power cord 141, and electrical plug 142, which were discussed in conjunction with FIG. 1A. FIG. 2C also shows socket pins 125*a-c*, electrical wires 126*a-c*, socket pins 133*a-c*, first waterproof seal 151, and second waterproof seal 152, which were discussed in conjunction with FIG. 1B. FIG. 1C further includes at least an opening 119.2. In other embodiments, FIG. 1C may not have all of the elements or features listed and/or may have other elements or features instead of or in addition to those listed.

Opening 119.2 is a circular opening at the bottom of middle chamber 118 of swivel head container 116, opposite to the swivel head cover 111, for the swivel core head assembly 119.1 to go through. In at least one embodiment, the first waterproof seal 151 is placed in the opening 119.2 for providing a watertight seal in-between opening 119.2 and the swivel core head assembly 119.1.

Figure 2:
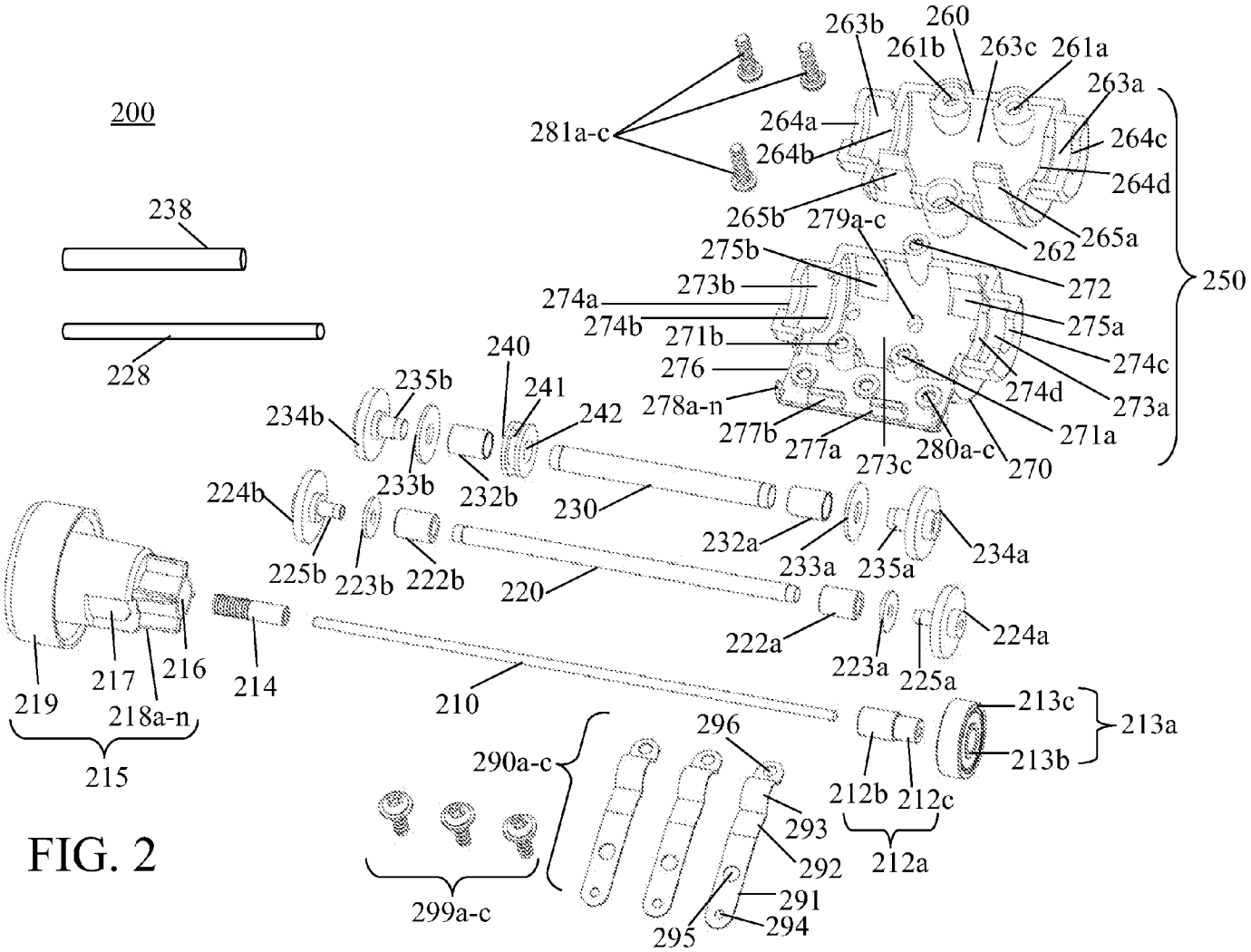
FIG. 2 shows a view of elements of an embodiment of a swivel core.

FIG. 2 shows a view of an embodiment of elements of swivel core 200. The swivel core 200 may include at least a central conductor rod 210. The swivel core 200 also includes at least a rod head bushing 212*a*, which includes at least a bushing portion 212*b* and a connector 212*c*. The swivel core 200 also includes at least a bearing 213*a*, which includes at least an inner disk 213*b* and an outer disk 213*c*. The swivel core 200 further includes at least a rod tail bushing 214, and a tail end stub 215 that includes at least a hole 216, an opening

217, flanges 218*a-n*, and a base 219. The swivel core 200 further includes at least a first conductor tube 220, a first pair of bushings 222*a* and 222*b*, a first pair of washers 223*a* and 223*b*, a first pair of spacers 224*a* and 224*b* that include extended tubes 225*a* and 225*b*, a first spacing tube 228, a second conductor tube 230, a second pair of bushings 232*a* and 232*b*, a second pair of washers 233*a* and 233*b*, a second pair of spacers 234*a* and 234*b* that have extended tubes 235*a* and 235*b*, and a second spacing tube 238. The swivel core may also include at least a ring 240 that includes a groove 241 and a hole 242. The swivel core 200 also includes a swivel core housing 250, which includes at least a housing cover 260 and a housing base 270. The housing cover 260 includes at least a pair of holes 261*a* and 261*b*, a guiding tube 262, a head chamber 263*a*, a tail chamber 263*b*, a middle chamber 263*c*, openings 264*a-d*, a pair of tabs 265*a* and 265*b*. The housing base 270 includes at least a pair of poles 271*a* and 271*b*, a pole 272, a head chamber 273*a*, a tail chamber 273*b*, a middle chamber 273*c*, openings 274*a-d*, a pair of tab slots 275*a* and 275*b*, a side plate 276, a pair of spacers 277*a* and 277*b*, a plurality of guiding stubs 278*a-n*, alignment holes 279*a-c*, and three screw holes 280*a-c*. The swivel core further includes three contact plates 290*a-c*, each of which includes a plate body 291, a plate neck 292, a plate head 293, a hole 294, a hole 295, and a hole 296. The swivel core 200 further includes screws 281*a-c* and screws 299*a-c*. In other embodiments, swivel core 200 may not have all of the elements or features listed and/or may have other elements or features instead of or in addition to those listed.

Central conductor rod 210 is an elongated rod made of electrical conductive materials for conducting electricity. In one embodiment, the central conductor rod 210 is made of stainless steel. In at least one embodiment, both ends of the central conductor rod 210 have a diameter that is slightly less than the middle part of the central conductor rod 210, for tightly fitting into a rod head bushing and a rod tail bushing, while preventing both bushings from sliding to the middle part of the central conductor rod 210. In at least one embodiment, the central conductor rod 210, rod head bushing, and rod tail bushing rotates together about the longitudinal axis. The end of central conductor rod 210 that fits into the rod head bushing is referred to as the head end of central conductor rod 210, while the end of central conductor rod 210 that fits into the rod tail bushing is referred to as the tail end of central conductor rod 210. Optionally, other structures such as a conductor tube may be substituted for the central conductor rod 210.

Rod head bushing 212*a* is a tube shaped bushing made of electrically conductive materials. In one embodiment, the rod head bushing 212*a* is made of brass. In at least one embodiment, rod head bushing 212*a* serves to reduce contact resistance while maintaining the continuity of electricity. One end of rod head bushing 212*a* (bushing portion 212*b*) tightly fits onto the head end of central conductor rod 210, while the other end of rod head bushing 212*a* (connector 212*c*) tightly fits into an inner disk of a bearing thus connecting the rod head bushing 212*a* with the bearing.

In at least one embodiment, bushing portion 212*b* of the rod head bushing 212*a* is a conductive tubular sleeve with an inner diameter that is slightly greater than the diameter of the head end of central conductor rod 210, and slightly less than or equal to the diameter of the rest of central conductor rod 210 (which is referred to as the middle part of central conductor rod 210), so that the bushing portion 212*b* can tightly fit onto the head end of central conductor rod 210 without sliding to the middle part of conductor rod 210.

In at least one embodiment, connector 212*c* of the rod head bushing 212*a* is a tubular structure for connecting the rod head bushing 212*a* with the inner disk of the bearing. In one embodiment, connector 212*c* has an outer diameter that is slightly greater than the inner diameter of the inner disk of the bearing. So when the connector 212*c* is pressed into the inner disk and creates an extremely high pressure and friction, the connector 212*c*, and the inner disk of the bearing are locked together and turn in unison. In other embodiments, the connector 212*c* of rod head bushing 212*a* is tightly connected to the inner disk of the bearing using other methods. In at least one embodiment, the outer diameter of connector 212*c* is slightly less than the outer diameter of bushing portion 212*b*, so that the inner disk of the bearing cannot slide onto the bushing portion 212*b* of rod head bushing 212*a*.

Bearing 213*a* is a rotating element that has an inner disk that is interlocked with an outer disk in a manner such that the outer disk can rotate with respect to the inner disk. Optionally, steel balls are inserted in a race between the inner disk and outer disk to maintain a separation of the inner disk and the outer disk, while reducing rotational friction and supporting radial and axial loads. In other words, in an embodiment, the steel balls are located in a circular track in-between the inner disk and the outer disk, which rotate with respect to one another. For example, when the inner disk rotates with respect to the outer disk, because the steel balls are rolling, they have a much lower coefficient of friction than if two flat surfaces were sliding against each other. In at least one embodiment, the inner disk of the bearing 213*a* press fits onto the connector 212*c* of rod head bushing 212*a*, while the outer disk of the bearing 213*a* tightly fits into a head chamber of a swivel core housing. In at least one embodiment, the central conductor rod 210, rod head bushing 212*a*, and the inner disk of bearing 213*a* rotate together about the longitudinal axis, while the outer disk of bearing 213*a* stays stationary with respect to the swivel core housing. In at least one embodiment, the bearing 213*a* also serves as a support, which for example, bears axial forces when the central conductor rod 210 is pulled or pushed along the longitudinal axis. In one embodiment, the bearing 213*a* is a deep-groove bearing with deep, uninterrupted raceway grooves having a close contact with the steel balls, enabling the bearing 213*a* to accommodate radial and axial loads in both directions. In other embodiments, other types of bearing structures may be substituted for the bearing 213*a*.

Inner disk 213*b* is a disk or ring structure that rotates within bearing 213*a*. In an embodiment, inner disk 213*b* fits in a groove formed by an outer circular surface (e.g., the outer disk) that is shaped so that the steel balls of the bearing 213*a* slightly loose fit in the groove. In at least one embodiment, the inner diameter of the inner disk 213*b* is slightly smaller than the outer diameter of connector 212*c*, so that inner disk 213*b* press fits onto the connector 212*c* of rod head bushing 212*a* and rotates in unison.

Outer disk 213*c* is a ring or disk structure that is slideably interlocked with inner disk 213*b*. Outer disk 213*c* may include a groove into which inner disk 213 is inserted, or inner disk 213 may include a groove into which outer disk 213 is inserted. Optionally outer disk 213*c* includes a groove formed by the inner circular surface that is shaped so that the steel balls of the bearing 213*a* fit in with a small amount of slack, so as to roll as inner disk 213*b* and outer disk 213*c* rotate with respect to one another. In at least one embodiment, the outer disk 213*c* tightly fits into the head chamber of the swivel core housing so that the outer disk 213*c* stays stationary with respect to the swivel core housing.

Rod tail bushing 214 is a tube shaped bushing made of electrical conductive materials. In one embodiment, rod tail bushing 214 is made of brass (or alternatively may be made from any of the conductive materials mentioned earlier in the specification). Rod tail bushing 214 serves to tightly connect the central conductor rod 210 to a tail end stub while maintain the continuity of electricity. One end of rod tail bushing 214 tightly fits onto the tail end of central conductor rod 210, while the other end of rod tail bushing 214 tightly fits into the tail end stub that is further affixed into the swivel tail 120 (FIGS. 1A-1C). In one embodiment, the rod tail bushing 214 has an inner diameter that is slightly greater than the diameter of the tail end of central conductor rod 210, and slightly less than or equal to the diameter of the middle part of central conductor rod 210 and the vast majority of the rest of central conductor rod 210, so that the rod tail bushing 214 can tightly fit onto the tail end of central conductor rod 210 without sliding past the end of central conductor rod 210 to the middle part. In an embodiment, rod tail bushing 214 never slides so far as to pass completely through and stick out the opposite end of rod tail bushing 214. In one embodiment, the end of rod tail bushing 214 that fits into the tail end stub has screw threads that allow the rod tail bushing 214 to screw into the tail end stub for tightly connecting the two. In another embodiment, the rod tail bushing 214 press fits into the tail end stub. In other embodiments, other methods may be used to tightly connect the rod tail bushing 214 to the tail end stub. In at least one embodiment, the swivel tail 120, the tail end stub, the rod tail bushing 214, the central conductor rod 210, the rod head bushing 212*a*, and the inner disk 213*b* of bearing 213*a* rotate together about the longitudinal axis with respect to the outer disk 213*c* and the swivel core housing that is tightly attached inside the swivel head 110.

Tail end stub 215 is a plastic stub that tightly connects to the rod tail bushing 214 and at the other end is tightly affixed inside the swivel tail 120. In at least one embodiment, the top of tail end stub 215 includes a hole surrounded by plastic panels, for tightly engaging the rod tail bushing 214. The tail end stub 215 also includes a base that could be affixed into the swivel tail container 123 with the top of tail end stub 215 facing the swivel tail cover 121 (FIGS. 1A-1C), so that the swivel tail container 123 and tail end stub 215 rotate together. In at least one embodiment, the tail end stub 215 also includes an opening on the side wall in-between the top and the base, which opening allows electrical wires 126*a-c* to run through the tail end stub 215.

Hole 216 is a circular opening on the top of the tail end stub 215, into which the rod tail bushing 214 is affixed. In one embodiment, the hole 216 is a screw hole so that the rod tail bushing 214 may screw into the hole 216. In another embodiment, the hole 216 has a cross section that is slightly smaller than the rod tail bushing 214, so that rod tail bushing 214 may press fit into the hole 216. In other embodiments, other slots or structures may be substituted for the hole 216.

Opening 217 is an opening on the side wall in-between the top and the base of tail end stub 215, through which electrical wires 126*a-c* may go through to electrically connect the tail assembly of swivel core 200 and the electrical socket 124 at the bottom of swivel tail container 123 (FIG. 1A-1C). Optionally, the opening 217 may be rectangular or in other shapes. In one embodiment, there may be multiple openings on the tail end stub 215 for the electrical wires to go through.

Flanges 218*a-n* are rectangular panels or fins extending radically away from the hole 216, for supporting the structure of hole 216. Flanges 218*a-n* are optional. In one embodiment, flanges 218*a-n* includes four panels. In another embodiment, the flanges 218*a-n* may include other numbers of panels. In other embodiments, other supporting structures may be substituted for the flanges 218*a-n*.

Base 219 is a circular base of the tail end stub 215 for connecting the tail end stub 215 and the swivel tail container 123 (FIGS. 1A-1C). In at least one embodiment, the base 219 is tightly fitted into the swivel tail container 123 (how is the base affixed?)

First conductor tube 220 is an elongated cylindrical tube made of electrical conductive materials for conducting electricity. First conductor tube 220 carries the current of a different wire than central conductor 210. In one embodiment, the first conductor tube 220 is made of stainless steel. The first conductor tube 220 is shorter than the central conductor rod 210. In at least one embodiment, the first conductor tube 220 has an inner diameter that is slightly greater than the diameter of the middle part of central conductor rod 210, so that the first conductor tube 220 can slide onto the central conductor rod 210. In at least one embodiment, the outer diameter of both ends of the first conductor tube 220 is slightly smaller than the middle part of the first conductor tube 220, so that a first pair of bushings can tightly fit onto the ends of first conductor tube 220 without sliding to the middle part of the first conductor tube 220. In at least one embodiment, the two ends of first conductor tube 220 that are close to the head end and the tail end of the central conductor rod 210 are referred to as head end and tail end of first conductor tube 220, respectively.

First bushings 222*a* and 222*b* are two tube shaped bushings made of electrical conductive materials that tightly fit onto the head end and the tail end of the first conductor tube 220, respectively. In one embodiment, first bushings 222*a* and 222*b* are made of brass. First bushings 222*a* and 222*b* reduce the contact resistance while maintaining the continuity of electricity. In one embodiment, first bushings 222*a* and 222*b* are identical. In another embodiment, two bushings of different structures and/or sizes may be substituted for first bushings 222*a* and 222*b*. In at least one embodiment, each of first bushings 222*a* and 222*b*, at the end opposite to the first conductor tube 220, slides onto an extended tube of either one of a first pair of spacers. In at least one embodiment, the inner diameter of first bushings 222*a* and 222*b* is slightly greater than the outer diameter of both ends of first conductor tube 220, and slightly less than or equal to the outer diameter of the middle part, so that first bushings 222*a* and 222*b* tightly fit onto the ends of first conductor tube 220.

First washers 223*a* and 223*b* are two thin disk shaped plates with a hole in the middle, for the purpose of distributing the load of the first bushings 222*a* and 222*b* toward the first spacers. In one embodiment, the first washers 223*a* and 223*b* are made of stainless steel or other materials. The first washers 223*a* and 223*b* serve to distribute force and prevent wearing or cracking of the first spacers. Each of the first washers 223*a* and 223*b* is placed in-between one of the first spacers and one of the first bushings 222*a* and 222*b* at either the head end or the tail end. In at least one embodiment, the first washers 222*a* and 222*b* are optional.

First spacers 224*a* and 224*b* are two spacers made of non-conductive materials including a disk shaped rim with an extended tube structure in the middle. In one embodiment, first spacers 224*a* and 224*b* are made of a non-conductive material, such as plastic. In one embodiment, first spacers 224*a* and 224*b* are identical. In at least one embodiment, first spacer 224*a* is placed in-between the rod head bushing 212*a* and first bushing 222*a* for separating the two during assembling the swivel core 200, while the first spacer 224*b* is located in-between the rod tail bushing 214 and first bushing 222*b* at the tail end for separating the two. First spacers 224*a* and 224*b*, with the help of tubular protrusions attached to first spacers 224*a* and 224*b*, support first bushings 222*a* and 222*b*, respectively, which in-turn support first conductor tube 220, and consequently, first spacers 224*a* and 224*b* keep first bushings 222*a* and 222*b* and first conductor tube 220 from coming into electrical contact with central conductor rod 210. In at least one embodiment, the outer diameter of the disk shaped rim of first spacers 224*a* and 224*b* is greater than those of the first bushings 222*a* and 222*b*, the rod head bushing 212*a* and/or the rod tail bushing 214, for preventing the first bushings 222*a* and 222*b* from getting in contact with the rod head bushing 212*a* and the rod tail bushing 214, respectively. Each of the first spacers 222*a* and 222*b* also includes an extended tube structure in the middle, which is concentric to the disk shaped rim. In other embodiments, spacing structures in other shapes and/or sizes may be substituted for the first spacers 224*a* and 224*b*.

Extended tubes 225*a* and 225*b* are tubes extending from the middle of, and concentric to, the disk shaped rim of the first spacers 224*a* and 224*b*, respectively. In at least one embodiment, the extended tubes 225*a* and 225*b* are identical in shape and size, and face each other during assembling. In at least one embodiment, the inner diameter of the extended tubes 225*a* and 225*b* is slightly larger than the diameter of the middle part of the central conductor rod 210, so that the extended tubes 225*a* and 225*b* of first spacers 224*a* and 224*b* can slide onto the central conductor rod 210. In at least one embodiment, the outer diameter of the extended tubes 225*a* and 225*b* is slightly smaller than the inner diameter of first bushings 222*a* and 222*b*, and first washers 223*a* and 223*b*, so that first bushings 222*a* and 222*b*, and first washers 223*a* and 223*b* can slide onto the extended tubes 225*a* and 225*b*, respectively. In at least one embodiment, the extended tubes 225*a* and 225*b* serve to separate the first bushings 222*a* and 222*b* from coming into electrical contact with the central conductor rod 210. In at least one embodiment, after first bushings 222*a* and 222*b*, and first washers 223*a* and 223*b* slide onto the extended tubes 225*a* and 225*b*, the extended tubes 225*a* and 225*b* further fit into both ends of the first conductor tube 220, for separating the first conductor tube 220 from electrically contacting central conductor rod 210. Extended tubes 225*a* and 225*b* are the portions of spacers 224*a* and 224*b* that keep central conductor rod 210 and first conductor tube 220 from establishing electrical contact.

First spacing tube 228 is inserted in-between the central conductor rod 210 and first conductor tube 220 for separating the two. In at least one embodiment, the first spacing tube 228 is made of non-conductive materials (e.g., plastic). The first spacing tube 228 is optional. Optionally, the interior surface of first conductor tube 220 may be coated with a non-conductive material, the outer surface of central conductor rod 210 may be coated with a non-conductive material, and/or a cylindrical sleeve may be inserted over central conductor rod 210 to reduce the likelihood of central conductor rod 210 and first conductor tube 220 making electrical contact and the likelihood of arcing occurring between central conductor rod 210 and first conductor tube 220, even when there is no electrical contact.

Second conductor tube 230 is an elongated cylindrical tube made of electrical conductive materials for conducting electricity. Second conductor tube 230 carries a different current than central conductor rod 210 and first conductor tube 220. For example, central conductor rod 210 may be the ground wire, first conductor tube 210 may carry the positive current and second conductor tube 230 may carry the negative current. In one embodiment, the second conductor tube 230 is made of stainless steel. The second conductor tube 230 is shorter than the first conductor tube 220. The second conductor tube 230 can slide onto the first conductor tube 220. In at least one embodiment, the outer diameter of both ends of the second conductor tube 230 is slightly smaller than the middle part of the second conductor tube 230, so that a second pair of bushings can tightly fit onto the ends of second conductor tube 230 without sliding to the middle part of the second conductor tube 230. The ends of second conductor tube 230 close to the head end and tail end of the central conductor rod 210 are referred to as the head end and the tail end of the second conductor tube 230, respectively.

Second bushings 232*a* and 232*b* are similar to the first bushings 222*a* and 222*b*, except that second bushings 232*a* and 232*b* have an inner diameter that is slightly greater than the ends of second conductor tube 230 and slightly less than or equal to the middle part of second conductor tube 230, for tightly fitting onto the ends of the second conductor tube 230. In at least one embodiment, each of the second bushings 232*a* and 232*b*, at the end opposite to the second conductor tube 230, slide onto an extended tube of either one of a second pair of spacers. In one embodiment, the bushing portion 212*b* of rod head bushing 212*a*, the first bushing 222*a*, and the second bushing 232*a* have the same outer diameter. In other embodiments, the outer diameters of the bushing portion 212*b*, the first bushings 222*a* and 222*b*, and the second bushings 232*a* and 232*b* may be different.

Second washers 233*a* and 233*b* are similar to the first washers 223*a* and 223*b*, except that the second washers 223*a* and 223*b* have a greater inner diameter and are placed in-between second bushings 232*a* and 232*b* and second spacers at the head end and the tail end, respectively. In one embodiment, the second washers 233*a* and 233*b* are optional. In one embodiment, a washer may be placed in-between the rod head bushing 212*a* and the first spacer 224*a*, and/or in-between the rod tail bushing 214 and the first spacer 224*b*. In one embodiment, washers may be placed in-between the first bushings 222*a* and 222*b* and second spacers at the head end and the tail end, respectively.

Second spacers 234*a* and 234*b* are similar to the first spacers 224*a* and 224*b*, except that the second spacers 234*a* and 234*b* have greater inner diameter and are placed in-between the first bushings 222*a* and 222*b* and the second bushings 232*a* and 232*b*, respectively, for separation purposes. In at least one embodiment, each of the second spacers 234*a* and 234*b* also has an extended tube structure in the middle and concentric to the disk shaped rim structure. In other embodiments, spacing structures of other shapes and/or sizes may be substituted for the second spacers 234*a* and 234*b*.

Extended tubes 235*a* and 235*b* are tubular structures extending from the middle of second spacers 234*a* and 234*b*, respectively. In at least one embodiment, extended tubes 235*a* and 235*b* slide onto the first conductor tube 220, and slide into the second bushings 232*a* and 232*b*, and second washers 233*a* and 233*b*, respectively. In at least one embodiment, extended tubes 235*a* and 235*b* serve to separate the second bushings 232*a* and 232*b* from coming into electrical contact with the first conductor tube 220. First conductor tube 220 is concentric with or at least located inside of second conductor tube 230. In at least one embodiment, after the second bushings 232*a* and 232*b*, and the second washers 233*a* and 233*b* slide onto the extended tubes 235*a* and 235*b*, the extended tubes 235*a* and 235*b* further fit into both ends of the second conductor tube 230, for separating the second conductor tube 230 from electrically contacting first conductor tube 220.

Second spacing tube 238 is inserted in-between the first conductor tube 220 and second conductor tube 230 for separating the two. In at least one embodiment, the second spacing tube 238 is made of non-conductive materials (e.g., plastic). The second spacing tube 238 is optional. Optionally, the interior surface of second conductor tube 230 may be coated with a non-conductive material, the outer surface of first conductor tube 220 may be coated with a non-conductive material, and/or a cylindrical sleeve may be inserted over first conductor tube 220 to reduce the likelihood of first conductor tube 220 and second conductor tube 230 making electrical contact and the likelihood of arcing occurring between first conductor tube 220 and second conductor tube 230, even when there is no electrical contact.

Ring 240 is a sandwich-cookie shaped or spool shaped ring with two disk shaped plates separated by a short tube. The two disks are concentric with the short tube. In at least one embodiment, the ring 240 is made of stainless steel or other materials. The ring 240 has a hole in the middle for sliding onto the second conductor tube 230. The two disk shaped plates and the middle ring forms a circular groove facing away from the center of the ring 240. In at least one embodiment, ring 240 is placed in a circular opening at a tail groove of swivel core housing, for the purpose of supporting and aligning the concentric conductor rod and tubes and preventing cracking and wearing of the swivel core housing.

Groove 241 of the ring 240 is a circular opening in-between the two disk shaped plates of ring 240. In at least one embodiment, groove 241 is placed on the edge of the opening at the tail groove of swivel core housing, so that the ring can fit in the opening for supporting and aligning the swivel core. In one embodiment, the groove 241 fits tightly at the opening at swivel core housing, so that the ring 240 stays stationary with respect to the swivel core housing.

Hole 242 is a circular opening with an inner diameter that in an embodiment is slightly greater than the outer diameter of the middle part of the second conductor tube 230, so that the ring 240 can slide onto the second conductor tube 230. In at least one embodiment, when ring 240 fits securely in the opening at the tail groove of swivel core housing, the second conductor tube 230 is a little loose in the hole 242 and can rotate freely about the longitudinal axis.

The swivel core housing 250 is a container having a middle cylindrical chamber with two concentric side cylindrical chambers, one on either side of the middle chamber. In one embodiment, the swivel core housing 250 is made of thin plastic or other hard nonconductive materials. In one embodiment, the two side chambers are identical and facing each other, each side chamber having a hole at the base opposite to the middle chamber. In one embodiment, the cross section of the middle chamber is greater than the cross section of the side chambers. In at least one embodiment, the swivel core housing 250 includes a housing cover and a housing base, each of which includes halves of (or complementary fractions of) the middle and side chambers, with the housing base having a side plate extending radically from one side of the housing base.

In at least one embodiment, the swivel core housing 250 encloses at least the head ends of central conductor rod 210, first conductor tube 220, and second conductor tube 230 along the longitudinal axis of the swivel core housing 250, as well as the rod head bushing 212*a*, the bearing 213*a*, the first bushing 222*a*, the first washer 223*a*, the first spacer 224*a*, the second bushing 232*a*, the second washer 233*a*, and the second spacer 234*a*. In at least one embodiment, the swivel core housing 250 is tightly attached inside the swivel head container 116. In other embodiments, the swivel core housing 250 may be molded into other shapes.

Housing cover 260 includes halves of the middle chamber and side chambers of swivel core housing 250. The housing cover 260 is affixed, optionally via screws and hooks, to a housing base to form the container of swivel core housing 250. In at least one embodiment, the housing cover 260 includes at least a pair of holes 261*a* and 261*b*, a slot 262, a head chamber 263*a*, a tail chamber 263*b*, a middle chamber 263*c*, openings 264*a-d*, and a pair of hooks 265*a* and 265*b*. In other embodiments, housing cover 260 may not have all of the elements or features listed and/or may have other elements or features instead of or in addition to those listed.

Holes 261*a* and 261*b* are two holes or slots located on one side of housing cover 260 for aligning two screws which are inserted through two screw holes on the housing base and affix the housing cover 260 to the housing base.

Guiding Tube 262 is a tubular structure on the side of housing cover 260 opposite to the holes 261*a* and 261*b*, for fitting onto a guiding pole of the housing base and aligning a screw that engages with a screw hole on the guiding pole.

Head chamber 263*a* is a portion (e.g., a half) of a cylindrical chamber at the housing cover 260, which meets with another portion of the cylindrical chamber at the housing base to form one of the two side chambers, within which the outer disk 213*c* of the bearing 213*a* is tightly attached and stays stationary with respect to the swivel core housing 250.

Tail chamber 263*b* is a portion (e.g., a half) of a cylindrical chamber at the housing cover 260 opposite to the head chamber 263*a*, which meets with another portion of the cylindrical chamber at the housing base to form the side chamber opposite to the head chamber 263*a*. Tail chamber 263*b* includes a semicircular opening at the base opposite to the middle chamber.

Middle chamber 263*c* is a part of a cylindrical chamber (e.g. half of the chamber) in the midst of housing cover 260 in-between and sharing bases of the head chamber 263*a* and tail chamber 263*b*.

Opening 264*a-d* are four semicircular openings at the housing cover 260, which forms, together with another four semicircular openings at the housing base, four circular openings at the bases of the middle chamber and two side chambers of swivel core housing 250. Opening 264*a* is at the base of the tail chamber 263*b* opposite to the middle chamber 263*c*, and opening 264*b* is in-between the tail chamber 263*b* and the middle chamber 263*c*. Opening 264*c* is at the base of the head chamber 263*a* opposite to the middle chamber 263*c*, and opening 264*d* is in-between the head chamber 263*a* and the middle chamber 263*c*. In at least one embodiment, openings 264*a* and 264*c* have smaller cross sections than openings 264*b* and 264*d*. In at least one embodiment, the openings 264*a-d* are similar with the same cross section. In other embodiments, openings 264*a-d* have different shapes other than circular.

Tabs 265*a* and 265*b* are two tabs that engage with two slots at the housing base to securely fasten the housing cover 260 to the housing base. Tabs 265*a* and 265*b* each has a wedge shaped head at the top of a flange. The bases of the wedges are thicker than the flanges upon which the wedges are mounted. The heads of tabs 265*a* and 265*b* act as the head of a spear to hook and engage the slots into which tabs 265*a* and 265*b* are inserted. In other embodiments, other types of fasteners may be used. In this specification, whenever one type of fastener is used another type of fastener may be substituted to obtain a different embodiment. For example, screws, snaps, rivets, tabs (e.g., having wedge shaped heads) that engage in slots, glue, adhesives, and/or straps may be used for any of the fasteners in this specification. Screws, snaps, rivets, tabs (e.g., having wedge shaped heads) that engage in slots, glue, adhesives, and/or straps may be substituted one for another to obtain different embodiments. Also, in general, many fasteners have two parts that interlock with one another to hold two pieces together, where one of the two parts of the fastener is on one piece and another of the two parts in another piece. In this specification which piece has which part may be reversed to obtain a different embodiment. For example, two pieces—one piece having slots and one piece having tabs that interlock with the slots, which piece has the slots and which piece has the tabs may be reversed from that which is shown in the drawings to obtain another embodiment.

Housing base 270 includes a portion (e.g., a half) of the middle chamber and the side chambers that engages with the housing cover 260 to form the swivel core housing 250. In at least one embodiment, housing base 270 includes at least a pair of poles 271*a* and 271*b*, a pole 272, a head chamber 273*a*, a tail chamber 273*b*, a middle chamber 273*c*, an opening 274*a*, a pair of tab slots 275*a* and 275*b*, a side plate 276, a pair of spacers 277*a* and 277*b*, a plurality of guiding stubs 278*a-n*, alignment holes 279*a-c*, and three screw holes 280*a-c*. In other embodiments, housing base 270 may not have all of the elements or features listed and/or may have other elements or features instead of or in addition to those listed.

Poles 271*a* and 271*b* are two poles, each having a screw hole at the top, which align with holes 261*a* and 261*b* for receiving screws to affix the housing cover 260 to the housing base 270.

Pole 272 is a pole having a screw hole at the top, for fitting into the guiding tube 262 and receiving a screw to affix the housing cover 260 to the housing base 270.

Head chamber 273*a* is a portion (e.g., a half) of a cylindrical chamber that meets with the head chamber 263*a*. Head chamber 273*a* together with head chamber 263*a* form the side chamber, which tightly engaging the outer disk 213*c* of the bearing 213*a*.

Tail chamber 273*b* is a portion (e.g., a half) of a cylindrical chamber that meets with the tail chamber 263*b*. Tail chamber 273*b* and tail chamber 263*b* when placed together form the side chamber that is opposite to the side chamber formed by head chambers 263*a* and 273*a*.

Middle chamber 273*c* is a portion (e.g., a half) of a cylindrical chamber that meets with the middle chamber 263*c*. Middle chamber 273*c* and middle chamber 263*c* when placed together form the middle chamber that is in-between the head chamber formed by head chambers 263*a* and 273*a* and the tail chamber formed by tail chambers 263*b* and 273*b*.

Opening 274*a-d* are parts of (e.g., a half of) circular openings that form, together with the openings 264*a-d*, four circular openings at the bases of side chambers and the middle chamber 273*c* of swivel core housing 250. The edges of opening 264*a* and 274*a* engage with the groove 214 of ring 240, which ring 240 holes the conductor rod and tubes going through the opening and prevent tail chambers 263*b* and 273*b* from cracking and wearing.

Tab slots 275*a* and 275*b* are two slots or slits that engage tabs 265*a* and 265*b*, for aligning and fastening housing cover 260 to housing base 270. In other embodiments, other fasteners may be substituted for the tabs 265*a* and 265*b*, and tab slots 275*a* and 275*b*.

Side plate 276 is a rectangular plastic plate extending radially away from the side of housing base 270 having poles 271*a* and 271*b*. Side plate 276 attaches and supports three contact plates. The side plate 276 has three screw holes for three screws that affix one ends of the three contact plates onto the side plate 276. Optionally, the side plate 276 has guide stubs and/or spacers on one side facing the housing cover 260 for guiding and/or separating the contact plates.

Spacers 277*a* and 277*b* are two stubs made of nonconductive materials (e.g., plastic) on the side plate 276 facing the housing cover 260 for separating the three contact plates from each other. In other embodiments, spacers 277*a* and 277*b* are optional, and/or could be substituted by other structures for separating the contact plates.

Guiding stubs 278*a-n* are stubs on the side plate 276 facing the housing cover 260 for guiding the three contact plates to align with the three bushings (rod head bushing 212*a*, first bushing 222*a*, and second bushing 232*a*) on the head end of swivel core 200, so that the contact plates are kept in contact with the three bushings at the head end of swivel core 200. In other embodiments, guide stubs 278*a-n* are optional, or could be substituted by other structures.

Alignment holes 279*a-c* are three holes on the partial cylindrical side wall of the middle chamber 273*c* of the housing base 270, for aligning the three contact plates during assembly of the swivel core 200. In one embodiment, the alignment holes 279*a-c* are optional.

Screw holes 280*a-c* are three screw holes for three screws that affix one ends of the three contact plates to the side plate 276. In an embodiment, screw holes 280*a-c* have rims that are thicker than the walls of the rest of housing base 270 to reinforce holes 280*a-c* to prevent the rim of holes 280*a-c* form cracking. In other embodiments, other fasteners may be substituted for the screws and screw holes 280*a-c*.

Screws 281*a-c* are three screws that affix housing cover 260 to housing base 270. In one embodiment, other numbers of screws and screw holes 280*a-c* may be used. In other embodiments, other types of fasteners may be used to connect housing cover 260 and housing base 270.

Contact plates 290*a-c* (shown in the bottom right corner of FIG. 2) are three plates are made of conductive materials for conducting electricity. In one embodiment, contact plates 290*a-c* are made of stainless steel. In at least one embodiment, contact plates 290*a-c* are affixed to the side plate 276 on one ends, which is outside of swivel core housing 250, while the other ends of contact plates 290*a-c* are kept, inside of swivel core housing 250, and in contact with the bushing portion 212*b* of rod head bushing 212*a*, the first bushing 222*a*, and the second bushing 232*a*, respectively. In at least one embodiment, the contact plates 290*a-c* serves to maintain the continuity of electricity from wires attached to one end of the contact plates 290*a-c* to the three bushings at the other end of the contact plates 290*a-c*. Contact plates 290*a-c* stay stationary with respect to the swivel core housing 250, while the three bushings are rotating together with the conductor rod and tubes about the longitudinal axis. In one embodiment, the three contact plates 290*a-c* are identical. In other embodiments, plates of different shapes and/or sizes or other conductive structures may be substituted for contact plates 290*a-c*.

In at least one embodiment, each of the contact plates 290*a-c* includes at least a plate body 291, a plate neck 292, a plate head 293, a hole 294, a hole 295, and a hole 296. In other embodiments, contact plates 290*a-c* may not have all of the elements or features listed and/or may have other elements or features instead of or in addition to those listed.

Plate body 291 is a flat portion at one end of a contact plate that is affixed to the side plate 276, optionally via a screw. In at least one embodiment, the plate body 291 connects to a plate head, via a plate neck. In at least one embodiment, the plate body 291 includes a hole for affixing the plate body 291 to the side plate 276, and another hole for connecting to an electrical wire.

Plate neck 292 is a portion that connects the plate body 291 and a curved plate head. In at least one embodiment, the plate neck 292 is slightly bent in a direction that the curved plate head faces, to mechanically bias the plate head to stay in contact with one of the bushings enclosed in the swivel core housing 250.

Plate head 293 is a curved portion of one plate body 291. Plate head 293 has an inner concave surface and an outer convex surface. The inner concave surface of plate head 293 face the same direction into which plate neck 292 is bent. The concave side of plate head 293 faces and contacts one of rod head bushing 212*a*, the first bushing 222*a*, or the second bushing 232*a*. In an embodiment plate head 293 is contoured to have the same inner radius of curvature as the outer radius of the bushing contacting plate head 293. In one embodiment, at least one point on the plate head 293 is kept in contact with one of the rod head bushing 212*a*, the first bushing 222*a*, and the second bushing 232*a*, when the bushings, conductor rod and tubes are rotating about the longitudinal axis of swivel core 200. In one embodiment, all of, or most of, the concave surface of plate head 293 is kept in contact with one of the rod head bushing 212*a*, the first bushing 222*a*, and the second bushing 232*a*, when the bushings, conductor rod and tubes are rotating about the longitudinal axis of swivel core 200.

Hole 294 is a hole or slit located at the end of plate body 291 opposite to the plate head 293, for electrically connecting an electrical wire (e.g., by solder), while the other end of the electrical wire is connected to one of the plug pins 115*a-c* of the electrical plug 114 at the swivel head 110. In alternative embodiments, the wire may be wrapped around a screw that is inserted in hole 294 to the wire in place wrapped through and around hole 294 or attached to plate body 291 in another way.

Hole 295 is a hole on the plate body 291 for aligning the plate body 291 with one of the screw holes 280*a-c* for a screw to affix the plate body 291 to the side plate 276.

Hole 296 is a hole for aligning to one of the alignment holes 279*a-c* to assist assembling of the contact plates 290*a-c*.

Screws 299*a-c* are three screws that affix three contact plates 290*a-c* to the side plate 276 of the housing base 270. In one embodiment, other numbers of screws may be used. In other embodiments, other types of fasteners may be used to affix the contact plates 290*a-c* to the side plate 276. For example there may be two screws per contact plate 290*a-c*, which hold contact plates aligned instead of or in addition to the other mechanisms of holding contact plates 290*a-c* aligned.

Figure 3A:
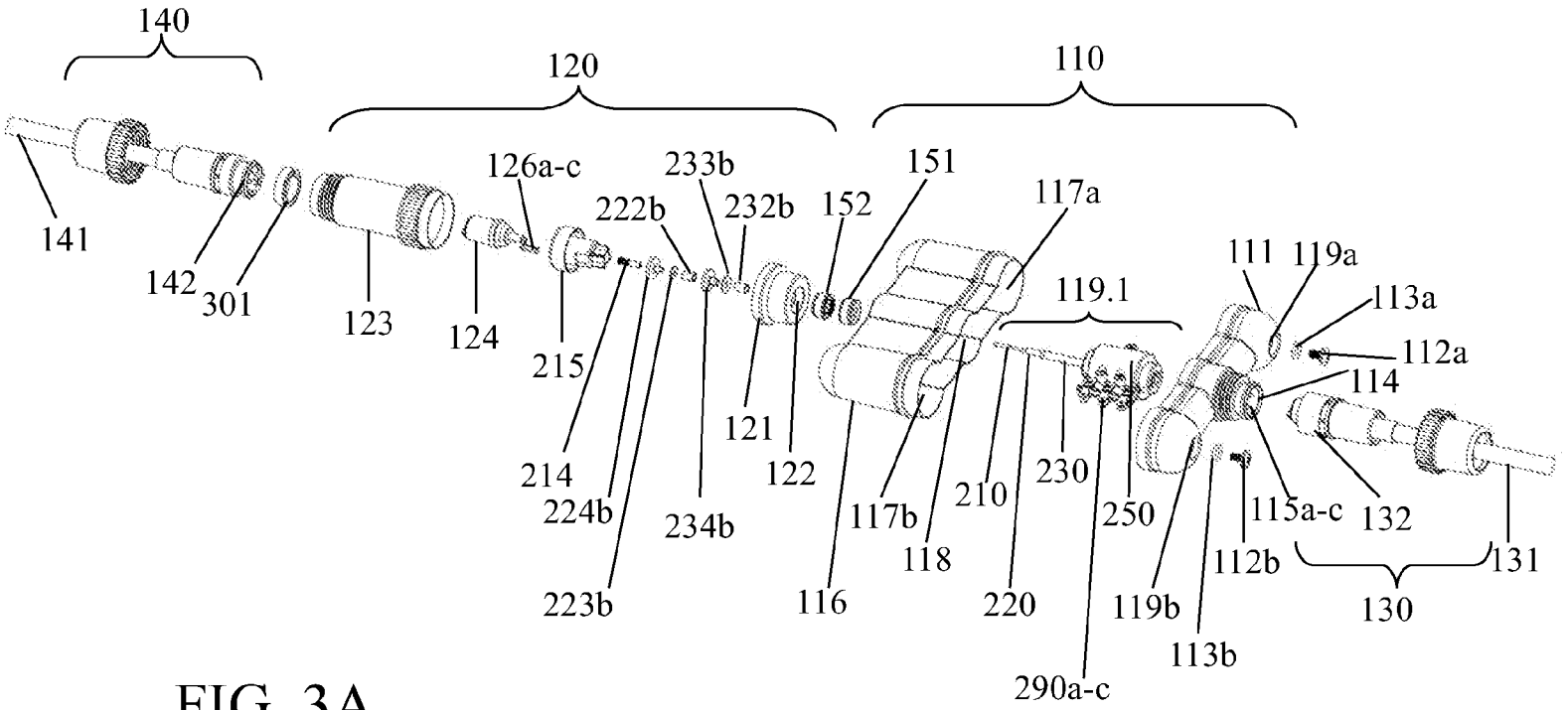
FIG. 3A shows another exploded view of an embodiment of the swivel cord-connector of FIG. 1A.

FIG. 3A shows an exploded view 300*a* of an embodiment of swivel cord-connector 100*a* of FIG. 1A. FIG. 3A includes swivel head 110, swivel head cover 111, screws 112*a* and 112*b*, o-rings 113*a* and 113*b*, electrical plug 114, plug pins 115*a-c*, swivel head container 116, side chambers 117*a* and *b*, middle chamber 118, drain ports 119*a* and 119*b*, swivel core head assembly 119.1, swivel tail 120, swivel tail cover 121, opening 122, swivel tail container 123, electrical socket 124, electrical connector 130, power cable 131, electrical socket 132, electrical connector 140, power cord 141, and electrical plug 142, which were discussed in conjunction with FIG. 1A. FIG. 3A further shows electrical wires 126*a-c*, first waterproof seal 151, second waterproof seal 152, which were discussed in conjunction with FIG. 1B. FIG. 3A also shows central conductor rod 210, first conductor tube 220, second conductor tube 230, swivel core housing 250, contact plates 290*a-c*, rod tail bushing 214, tail end stub 215, first bushing 222*b*, first washer 223*b*, first spacer 224*b*, second bushing 232*b*, second washer 233*b*, and second spacer 234*b*, which were discussed in conjunction with FIG. 2. FIG. 3A further includes a third waterproof seal 301. In other embodiments, FIG. 3A may not have all of the elements or features listed and/or may have other elements or features instead of or in addition to those listed.

Exploded view 300*a* is different than the views of FIGS. 1A-1C in that third water proof 301 is present in exploded view 300*a*. Third water proof seal 301 is located in the left end of FIG. 3A between electrical plug 142 and swivel tail container 123. Third waterproof seal 301 is a circular waterproof ring or band, which may be made from made of elastomeric materials, for example, for providing a watertight seal in-between the swivel tail 120 and the electrical connector 140 to prevent water from getting in contact with the plug pins of electrical plug 142 and socket pins 125*a-c* of electrical socket 124. The third waterproof seal 301 may be made of rubber, silicon, or other materials. In at least one embodiment, the third waterproof seal 301 may be placed around the electrical plug 142. The third waterproof seal 301 is optional.

Figure 3B:
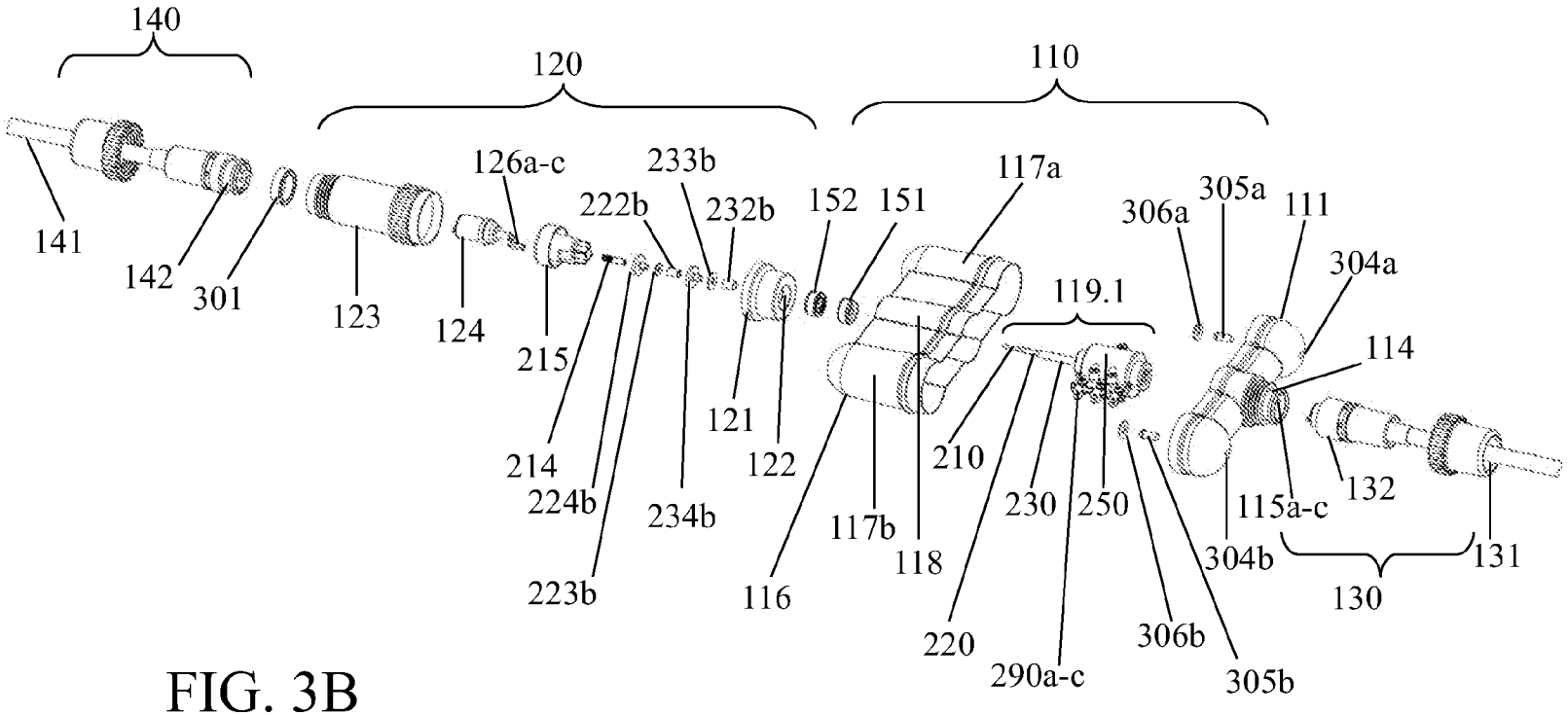
FIG. 3B shows an exploded view of an alternative embodiment of the swivel cord-connector of FIG. 1A.

FIG. 3B shows an exploded view 300*b* of an alternative embodiment of the swivel cord-connector of FIG. 1A. FIG. 3B includes swivel head 110, swivel head cover 111, electrical plug 114, plug pins 115*a-c*, swivel head container 116, side chambers 117*a* and *b*, middle chamber 118, swivel core head assembly 119.1, swivel tail 120, swivel tail cover 121, opening 122, swivel tail container 123, electrical socket 124, electrical connector 130, power cable 131, electrical socket 132, electrical connector 140, power cord 141, and electrical plug 142, which were discussed in conjunction with FIG. 1A. FIG. 3B further shows electrical wires 126*a-c*, first waterproof seal 151, second waterproof seal 152, which were discussed in conjunction with FIG. 1B. FIG. 3B also shows central conductor rod 210, first conductor tube 220, second conductor tube 230, swivel core housing 250, contact plates 290*a-c*, rod tail bushing 214, tail end stub 215, first bushing 222*b*, first washer 223*b*, first spacer 224*b*, second bushing 232*b*, second washer 233*b*, and second spacer 234*b*, which were discussed in conjunction with FIG. 2. FIG. 3B further includes third waterproof seal 301, which was discussed in conjunction with FIG. 3A. FIG. 3B may further include drain ports 304*a* and 304*b*, plugs 305*a* and 305*b*, and o-rings 306*a* and 306*b* (which were not shown in FIGS. 1A-3A). In other embodiments, FIG. 3B may not have all of the elements or features listed and/or may have other elements or features instead of or in addition to those listed.

The embodiment of FIG. 3B has different drain ports than those of FIGS. 1A-3A. In at least one embodiment, drain ports 304*a* and 304*b* are similar to drain ports 119*a* and 119*b*. In at least one embodiment, drain ports 304*a* and 304*b* may be sealed using plugs 305*a* and 305*b* from either inside or outside. Plugs 305*a* and 305*b* plug up drain ports 304*a* and 304*b*, and removing plugs 305*a* and 305*b* allows water to drain out of the swivel head 110. Optionally, o-rings 306*a* and 306*b* are located in-between the plugs 305*a* and 305*b* and the drain ports 304*a* and 304*b*, for preventing the water from getting into the swivel head 110. Plugs 305*a* and 305*b* and o-rings 306*a* and 306*b* may be made from any water tight material. In at least one embodiment, FIG. 3 provides alternative structures and/or methods for draining water out of swivel head 110.

Figure 4A:
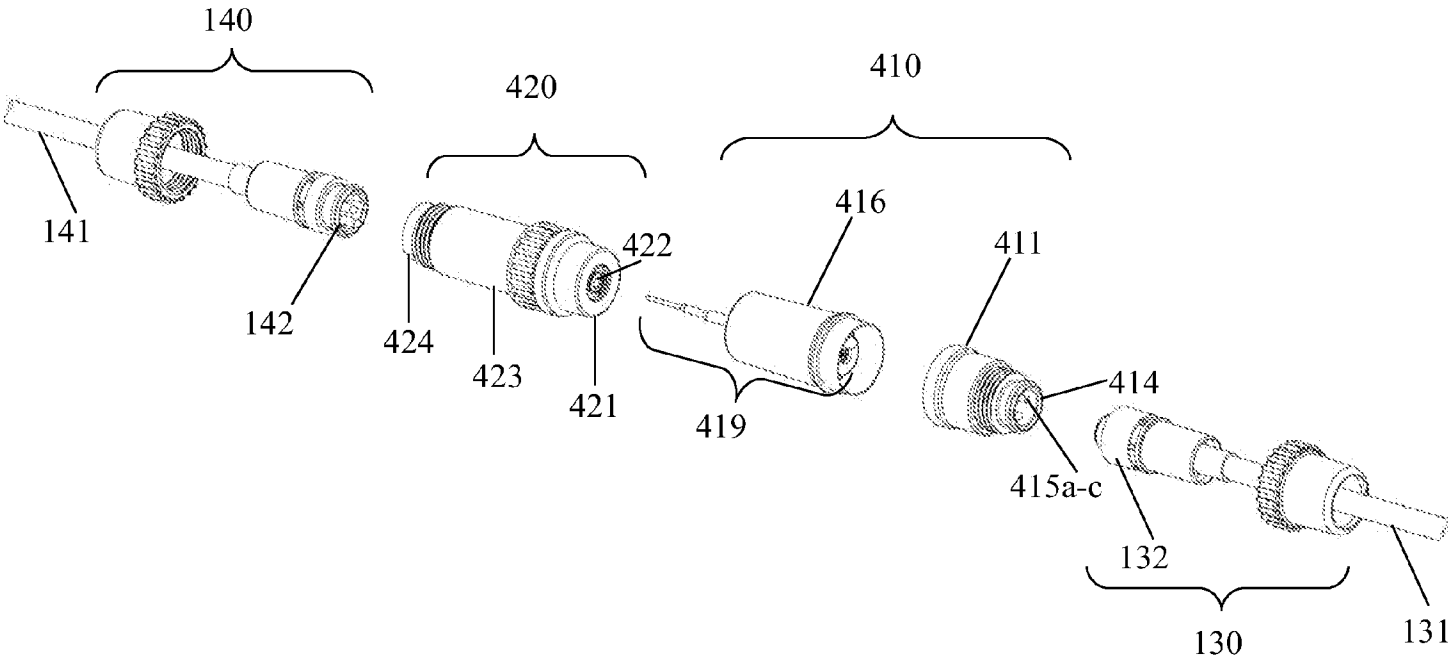
FIG. 4A shows a partially exploded view as an overview of an embodiment of a swivel cord-connector with a cylindrical swivel head.

FIG. 4A shows an embodiment of a swivel cord-connector 400*a* with a cylindrical swivel head. FIG. 4A includes a swivel head 410, which includes at least a swivel head cover 411, an electrical plug 414, three plug pins 415*a-c*, a swivel head container 416, and a swivel core head assembly 419. The swivel cord-connector 400*a* may further include a swivel tail 420, which includes at least a swivel tail cover 421, an opening 422, a swivel tail container 423, and an electrical socket 424. FIG. 4A also shows electrical connector 130, power cable 131, electrical socket 132, electrical connector 140, power cord 141, and electrical plug 142, which were discussed in conjunction with FIG. 1A. In other embodiments, swivel cord-connector 400*a* may not have all of the elements or features listed and/or may have other elements or features instead of or in addition to those listed.

Swivel cord-connector 400*a* differs from swivel cord-connector 100*a* in that swivel cord-connector 400*a* does not have an asymmetric swivel head. The swivel head of swivel cord-connector 400*a* does not have the pair of side chambers 117*a* and 117*b* (which make swivel head 110 asymmetric).

Swivel head 410 is a structure including a head assembly of a swivel core enclosed in a watertight cylindrical chamber. In at least one embodiment, the swivel head 410 includes an electrical plug that is electrically connected to the head assembly of the swivel core. In at least one embodiment, the tail of the swivel core goes into a swivel tail, thus connecting the swivel head 410 and the swivel tail. In at least one embodiment, the cylindrical swivel head 410 may rotate freely with respect to the swivel tail. In other embodiments, the swivel head 410 may have other shapes.

Swivel head cover 411 is a cover that engages with a cylindrical swivel head container to form the chamber of the swivel head 410. In at least one embodiment, the swivel head cover 411 includes an electrical plug that is concentric to the swivel head 410, with electrical plug pins facing away from the swivel head container.

Swivel head container 416 encloses the head assembly of the swivel core and engages tightly with the swivel head cover 411 to form the cylindrical chamber of the swivel head 410. In at least one embodiment, the head assembly of swivel core is tightly attached inside the cylindrical swivel head container 416, with the tail assembly of the swivel core protruding out through a circular opening at the bottom of swivel head container 416. In at least one embodiment, a waterproof seal is placed in the circular opening at the bottom of swivel head container 416 for preventing water from coming into the swivel head 410 during use.

In at least one embodiment, the swivel head 410 is connected to electrical connector 130, while the swivel tail 420 is connected to electrical connector 140. In at least one embodiment, electrical plug 414, plug pins 415*a-c*, swivel tail 420, swivel tail cover 421, opening 422, swivel tail container 423, electrical socket 424, and swivel core head assembly 419 are the embodiments of electrical plug 114, plug pins 115*a-c*, swivel tail 120, swivel tail cover 121, opening 122, swivel tail container 123, electrical socket 124, and swivel core head assembly 119.1, respectively, which were discussed in conjunction with FIG. 1A.

Figure 4B:
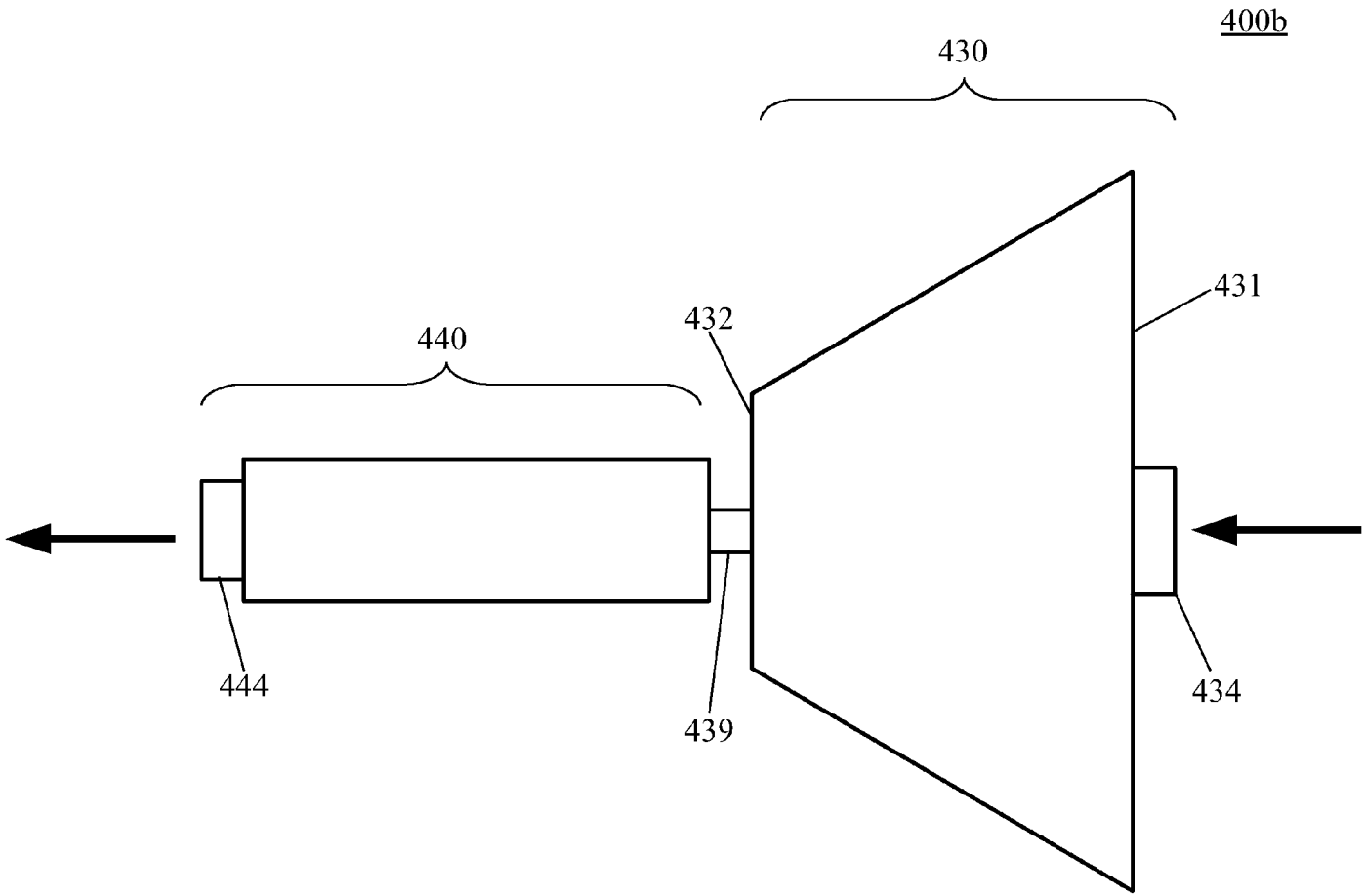
FIG. 4B shows a top view of an embodiment of a swivel cord-connector with a delta wing.

FIG. 4B shows a top view of an embodiment of a swivel cord-connector 400*b* with a delta wing. FIG. 4B includes at least a swivel head 430 that includes at least a top base 431, a bottom base 432, an electrical plug 434, a swivel core 439 that connects swivel head 430 with a swivel tail 440 that includes at least an electrical socket 444. FIG. 4B also shows two arrows indicating flow of electrical current in at least one embodiment. In other embodiments, swivel cord-connector 400*b* may not have all of the elements or features listed and/or may have other elements or features instead of or in addition to those listed.

In one embodiment, swivel cord-connector 400*b* is similar to swivel cord-connector 100*a* except that the swivel cord-connector 400*b* includes a swivel head with a delta wing for providing counter torque forces, instead of a double barrel wing as shown in FIG. 1A. In at least one embodiment, the swivel cord-connector 400*b* includes at least a swivel head with delta wing and a swivel tail, which are connected via a swivel core and can rotate with respect to each other. In at least one embodiment, the swivel head having the delta wing is connected to a power source via a power cord, while the swivel tail is connected to an electrical device via another power cord. In at least one embodiment, electrical current flows from the power source into the swivel head (as indicated by the arrow on the right), then through the swivel core to the swivel tail, and further runs out of the swivel tail (as indicated by the arrow on the left) to power the device that connects to the swivel tail.

Swivel head 430 is a watertight chamber with a delta wing for enclosing a head assembly of a swivel core. In at least one embodiment, the cross section of delta wing has two parallel bases (e.g., a top base 431 and a bottom base 432) and two sides, with the swivel core located in the middle of the delta wing while the delta wing provides counter torque forces to prevent the swivel head 430 from spinning along the longitudinal axis of the swivel core when placed on a surface. In at least one embodiment, the cross section of delta wing is in a shape of an isosceles trapezoid and the swivel core aligns the axis of the isosceles trapezoid. In at least one embodiment, the delta wing has other trapezoid shapes. In at least one embodiment, the swivel head 430 includes an electrical plug 434 (or electrical socket) at top base 431, which is electrically connected to the enclosed swivel core, and an opening at the bottom base 432 for the swivel core to go through and further into a swivel tail. In one embodiment, the top base 431 is wider than the bottom base 432. In another embodiment, the top base 431 is narrower than the bottom base 432. In at least one embodiment, electrical plug 434 is the same as electrical plug 114 as discussed in conjunction with FIG. 1A.

Swivel core 439 connects the swivel head 430 and the swivel tail so that the swivel tail may rotates with respect to the swivel head 430. In at least one embodiment, swivel core 439 is the same as the swivel core 200 of FIG. 2.

Swivel tail 440 is a cylindrical chamber enclosing a tail assembly of the swivel core 439 and may rotate with respect to swivel head 430. In at least one embodiment, swivel tail 440 is the same as swivel tail 120 as discussed in conjunction with FIG. 1A. In at least one embodiment, swivel tail 440 includes an electrical socket 444 (or an electrical plug) at the end opposite the swivel head 430, for connecting to a power cord that transmits electricity to an electrical device. In at least one embodiment, electrical socket 444 is the same as electrical socket 124 as discussed in conjunction with FIG. 1A.

Figure 4C:
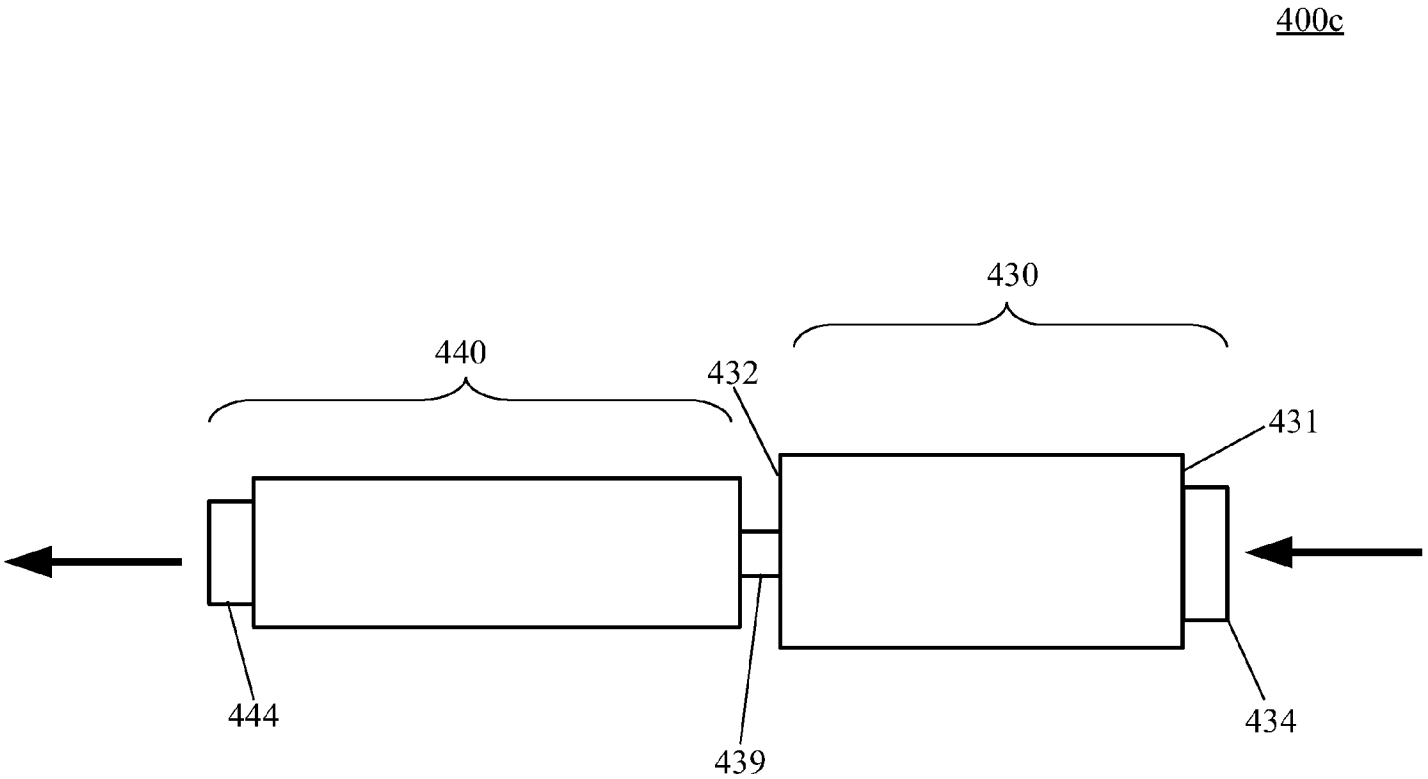
FIG. 4C shows a side view of an embodiment of the swivel cord-connector of FIG. 4B.

FIG. 4C shows a side view 400*c* of an embodiment of the swivel cord-connector 400*b* of FIG. 4B. Swivel cord-connector 400*b* (of FIG. 4C) includes at least swivel head 430, electrical plug 434, swivel core 439, swivel tail 440, electrical socket 444, and two arrows showing the flow of electrical current as an example, which were discussed in conjunction with FIG. 4B. In other embodiments, swivel cord-connector 400*b* may not have all of the elements or features listed and/or may have other elements or features instead of or in addition to those listed.

Figure 5A:
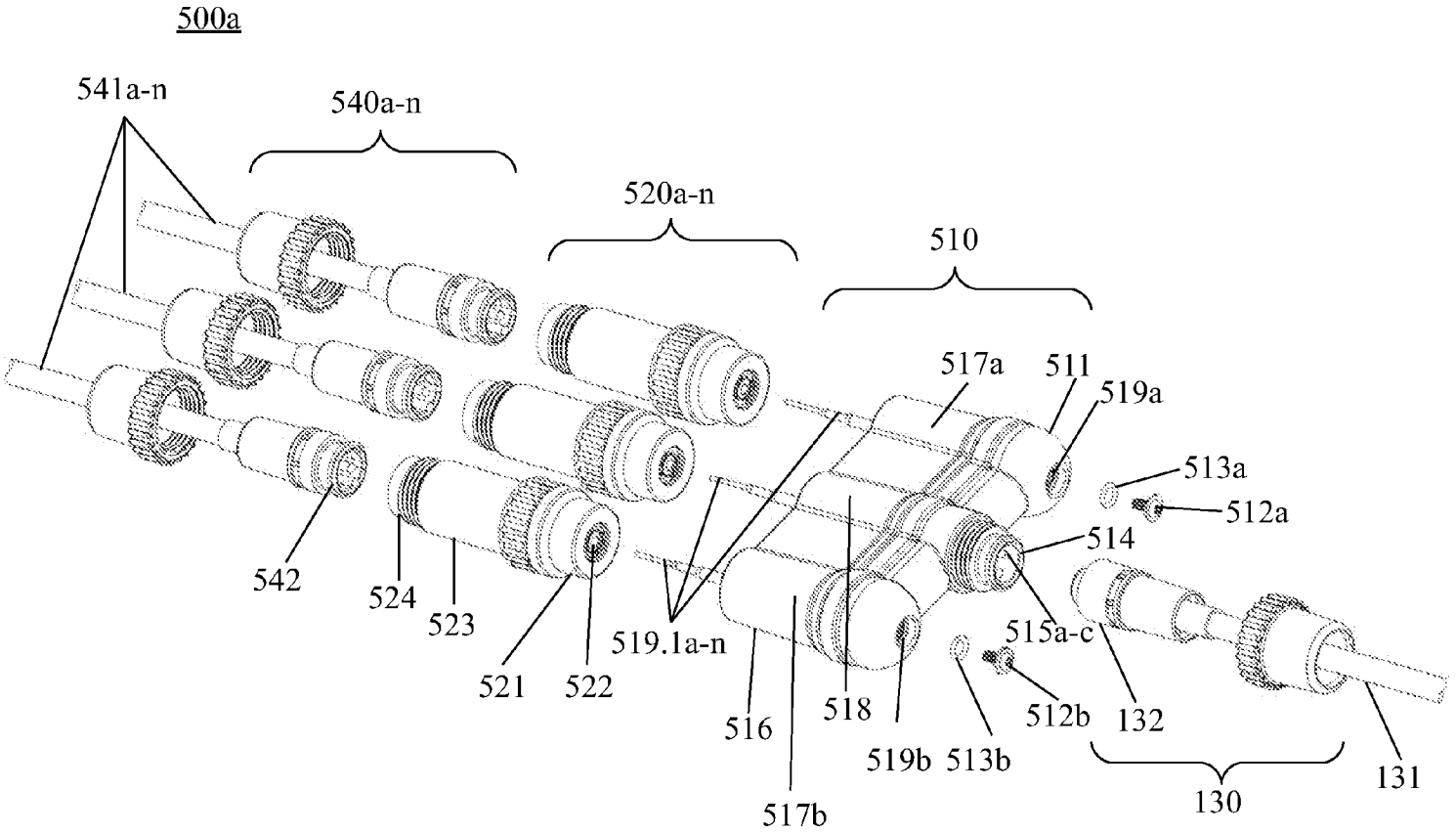
FIG. 5A shows a partially exploded view as an overview of an embodiment of a swivel cord-connector with multiple swivel tails.

Swivel head 430 of swivel cord-connector 400*b* has a flat chamber with a cross section that is close to a rectangle in the side view of FIG. 4C in one embodiment. In at least one embodiment, the delta wing of swivel head 430 lays flat on a surface and provides counter torque forces for preventing the swivel head 430 from spinning, FIG. 5A shows an overview of an embodiment of a swivel cord-connector 500*a* with multiple swivel tails. Swivel cord-connector 500*a* includes electrical connector 130, power cable 131, and electrical socket 132, which were discussed in conjunction with FIG. 1A. Swivel cord-connector 500*a* also includes a swivel head 510, which includes at least a swivel head cover 511, a pair of screws 512*a* and 512*b*, a pair of o-rings 513*a* and 513*b*, an electrical plug 514, three plug pins 515*a-c*, a swivel head container 516, a pair of side chambers 517*a* and 517*b*, a middle chamber 518, and two drain ports 519 *a* and 519*b*. The swivel head 510 may also include multiple swivel core head assembly 519.1*a-n*. The swivel cord-connector 500*a* may further include multiple swivel tails 520*a-n*, each of which includes at least a swivel tail cover 521, an opening 522, a swivel tail container 523, and an electrical socket 524. FIG. 5A further shows multiple power connectors 540*a-n*, each of which has an electrical plug 542, and multiple power cords 541*a-n*. In other embodiments, swivel cord-connector 500*a* may not have all of the elements or features listed and/or may have other elements or features instead of or in addition to those listed.

Swivel cord-connector 500*a* connects to a power cord that is connected to a power sources, such as an outlet on one end and may connect to multiple (e.g., three) power cords on the other end. Using swivel cord-connector 500*a*, one may power multiple devices from one outlet, for example. Swivel head 510 is a structure including head assemblies of multiple swivel cores enclosed in a watertight chamber. In at least one embodiment, the swivel cores are parallel to the longitudinal axis of swivel head 510. In at least one embodiment, the swivel head 510 has an asymmetrical structure that is similar to the swivel head 110, with a middle chamber having an electrical plug on top, and two side chambers forming a double barrel wing except that each barrel of swivel head 510 encloses a swivel core that further connects to a swivel tail for connecting to a power cord, whereas only the central barrel of swivel head 110 has an electrical plug on top to plug into a power cord. In at least one embodiment, swivel head 510 includes three parallel swivel cores, with the middle chamber and two side chambers each enclosing a swivel core. In at least one embodiment, each swivel core is electrically connected to the electrical plug on the top of the middle chamber on a head cover. In at least one embodiment, swivel head 510 has other shapes, and/or includes other numbers of swivel cores (e.g., two, four, five, six, seven, eight, or nine swivel cores).

In other embodiments, the swivel cores may be at other angles with respect to longitudinal axis. For example, the two outer swivel cores may be at 60 degrees from the longitudinal axis (and 120 degrees from each other), while the central swivel core may be parallel to the longitudinal axis.

In at least one embodiment, swivel head cover 511, screws 512*a* and 512*b*, o-rings 513*a* and 513*b*, middle chamber 518, drain ports 519 *a* and 519*b* are embodiments of swivel head cover 111, screws 112*a* and 112*b*, o-rings 113*a* and 113*b*, middle chamber 118, drain ports 119*a* and 119*b*, which were discussed in conjunction with FIG. 1A.

Electrical plug 514 and plug pins 515*a-c* are similar to the electrical plug 114 and plug pins 115*a-c*, except that the plug pins 515*a-c* of electrical plug 514 are connected to head assemblies of multiple swivel cores enclosed in the swivel head 510. For example, each of plug pins 515*a-c* is connected to three electrical wires, each of the three electrical wires is further connected to one of the three contact plates in one of the three swivel cores enclosed in swivel head 510.

Swivel head container 516 has a similar shape as the swivel head container 116, except that the swivel head container 516 includes three circular openings, one at each of the bottom of the middle chamber and two side chambers, in at least one embodiment. In one embodiment, the swivel head container 516 encloses the head assemblies of three parallel swivel cores, with the tails of the three swivel cores going out of the swivel tail container 516 through the three circular openings. In other embodiments, swivel head container 516 includes other numbers of openings, and/or encloses other numbers of swivel cores.

Side chambers 517*a* and 517*b* are two cylindrical chambers similar to side chambers 117*a* and 117*b*, except that each of side chambers 517*a* and 517*b* has a circular opening at the bottom for the tail of a swivel core to go through, and each of side chambers 517*a* and 517*b* includes wires transferring the electrical current from the electrical plug 514 at the middle chamber to a swivel core enclosed in each of side chambers 517*a* and 517*b*, and further to a swivel tail and a power cord electrically connected to the swivel tail.

Middle chamber 518 receives the electrical current from a power cord electrically connected to electrical plug 514 at middle chamber 518 at one end, and middle chamber 518 distributes the electrical power to side chambers 517*a* and 517*b* and to the power cords that connect to the swivel tails at the other ends of middle chamber 518 and side chambers 517*a* and 517*b*.

Swivel core head assemblies 519.1*a-n* are multiple assemblies, each of which is the same, as or similar to, swivel core head assembly 119.1. In at least one embodiment, swivel core head assemblies 519.1*a-n* includes head assemblies of three swivel cores. In other embodiments, swivel core head assemblies 519.1*a-n* may refer to other numbers of head assemblies that may be enclosed in the swivel head 510.

Swivel tails 520*a-n* are multiple swivel tails, each of which may be the same as the swivel tail 120. In at least one embodiment, each of swivel tails 520*a-n* includes at least swivel tail cover 521, opening 522, swivel tail container 523, and electrical socket 524, which may be the same as of swivel tail cover 121, opening 122, swivel tail container 123, and electrical socket 124 of FIG. 1A.

Power connectors 540*a-n* are multiple connectors, each of which may be the same as electrical connector 140. In at least one embodiment, each of power connectors 540*a-n* has an electrical plug 542 for connecting to electrical socket 524 of one of the swivel tails 520*a-n*. In at least one embodiment, electrical plug 542 is the same as electrical plug 142 of FIG. 1A.

In at least one embodiment, the multiple swivel tails 540*a-n* are connected to multiple power cords 541*a-n* via power connectors 540*a-n*. In at least one embodiment, power cords 541*a-n* are multiple cords, each of which is connected at the other end to a device or apparatus, which may or may not be the same. For example, one of the power cords 541*a-n* is connected to a pool cleaner, while another one of the power cords 541*a-n* may be connected to pool lights, and yet another one may be connected to an electrical water pump. In at least one embodiment, power cords 541*a-n* may include three power cords. In other embodiments, power cords 541*a-n* may include other numbers of power cords. In at least one embodiment, less than the number of swivel tails 520*a-n* may be in use, and a cap may be used to cover one of the electrical sockets 524 of swivel tails 520*a-n* when not in use.

In at least one embodiment, swivel cord-connector 500*a* may include the same numbers of swivel core head assemblies 519.1*a-n*, the swivel tails 520*a-n*, the power connectors 540*a-n*, and the power cords 541*a-n*. For example, one embodiment of swivel cord-connector 500*a* includes three swivel core head assemblies, three swivel tails, three power connectors, and three power cords. In other embodiments, the numbers of the components mentioned above may not be the same. For example, one embodiment of swivel cord-connector 500*a* may include four swivel core head assemblies, four swivel tails, three power connectors, and three power cords, while the fourth swivel tail not in use is covered, optionally via a cap, to prevent water from getting into the swivel tail. In yet another embodiment, other numbers of the components of swivel cord-connector 500*a* may be used.

Figure 5B:
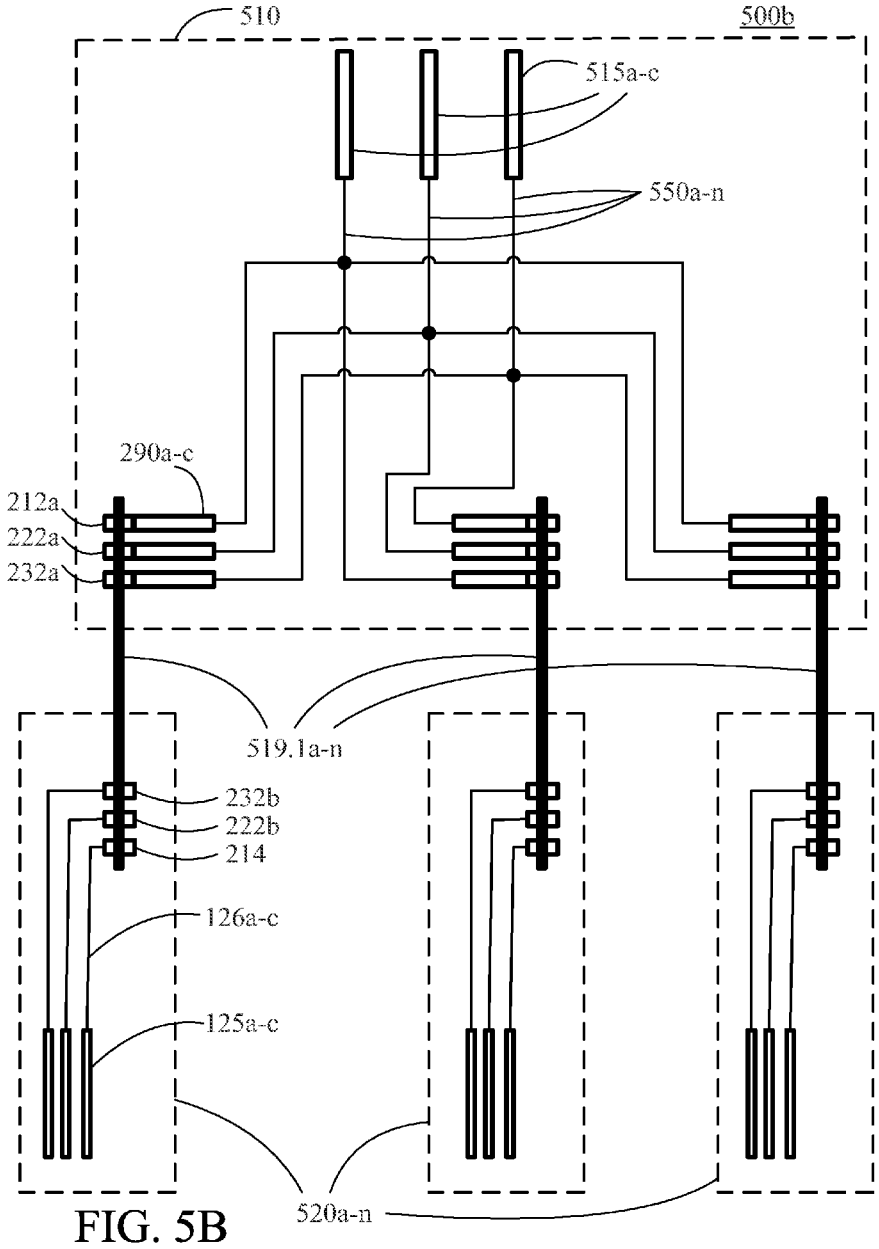
FIG. 5B shows a diagram illustrating an embodiment of electrical connections in the swivel cord-connector of FIG. 5A.

FIG. 5B shows a diagram 500*b* illustrating an embodiment of electrical connections in the swivel cord-connector 500*a* of FIG. 5A. FIG. 5B includes at least swivel head 510, plug pins 515*a-c*, swivel core head assemblies 519.1*a-n*, and swivel tails 520*a-n*, which were discussed in conjunction with FIG. 5A. FIG. 5B also shows, in the left as an example of a swivel core, at least contact plates 290*a-c*, rod head bushing 212*a*, rod tail bushing 214, first bushings 222*a* and 222*b*, second bushings 232*a* and 232*b*, as discussed in conjunction with FIG. 2. FIG. 5B further shows in the left socket pins 125*a-c* and electrical wires 126*a-c*, as discussed in conjunction with FIG. 1B. FIG. 5B further shows multiple electrical wires 550*a-n* for connecting plug pins 515*a-c* to multiple swivel core head assemblies 519.1*a-n* within swivel head 510. In other embodiments, FIG. 5B may not have all of the elements or features listed and/or may have other elements or features instead of or in addition to those listed.

In at least one embodiment, FIG. 5B shows how the elements of swivel cord-connector 500*a* are electrically connected so that electricity can be transmitted from a power source to the swivel head 510, and through the swivel core head assemblies 519.1*a-n* further to multiple swivel tails 520*a-n* that are connected to power cords. In at least one embodiment, a power cord that is connected to a power sources for example, connects to the electrical plug on swivel head 510 and transmits electrical current to plug pins 515*a-c* (e.g., one pin for a positive electrical line, one pin for a negative electrical line, and one pin for a ground line). The plug pins 515*a-c* are further electrically connected to contact plates of multiple swivel core head assemblies 519.1*a-n* via multiple electrical wires. In at least one embodiment, electrical current is transmitted from the plug pins 515*a-c* to the contact plates 290*a-c* of each swivel core via electrical wires, and further through three bushings at the head end (e.g., rod head bushing 212*a*, first bushing 222*a*, and second bushing 232*a*) to central conductor rod 210, first conductor tube 220, and second conductor tube 230. Central conductor rod 210, first conductor tube 220, and second conductor tube 230 of each swivel core carries electrical current to one of the swivel tails 520*a-n*, inside which electrical current runs through three bushings at the tail end of each swivel core (e.g., rod tail bushing 214, first bushing 222*b*, and second bushing 232*b*) to the socket pins 125*a-c* via electrical wires 126*a-c*. The multiple swivel tails 520*a-n* are further connected to multiple power cords to power multiple devices.

Electrical wires 550*a-n* are multiple electrical wires for connecting plug pins 515*a-c* to contact plates 290*a-c* of each of swivel core head assemblies 519.1*a-n*. In at least one embodiment, three of electrical wires 550*a-n* (e.g., one as a positive electrical line, one as a negative electrical line, and one as a ground line) electrically connects the three plug pins 515*a-c* to three contact plates 290*a-c* of the swivel core on the left in diagram 500*b*, respectively. In at least one embodiment, plug pins 515*a-c* are connected to contact plates 290*a-c* of the swivel core in the middle of diagram 500*b* via another three of the electrical wires 550*a-n*, and plug pins 515*a-c* are further connected to contact plates 290*a-c* of the swivel core on the right via yet another three of the electrical wires 550*a-n*. In at least one embodiment, the electrical wires 550*a-n* are soldered to plug pins 515*a-c* at one ends and/or to contact plates at the other ends.

Method of Use

Figure 6:
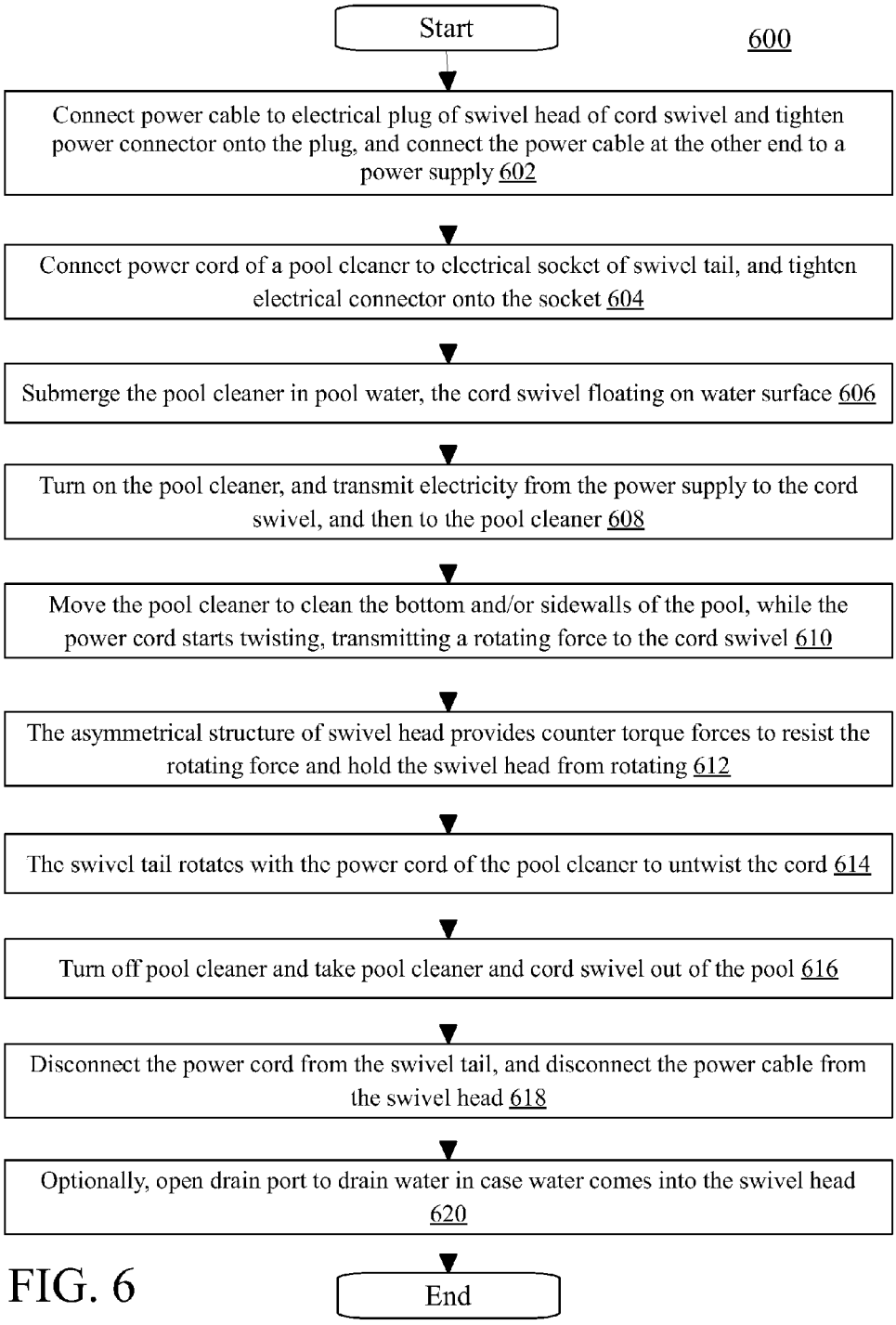
FIG. 6 shows a flowchart of an embodiment of a method of using the swivel cord-connector of FIG. 1A as an example.

FIG. 6 shows a flowchart of an embodiment of a method 600 for using the swivel cord-connector 100*a* of FIG. 1A.

In step 602, power cable 131 is connected to electrical plug 114 of swivel head 110 of swivel cord-connector 100*a*, optionally via electrical connector 130. The electrical connector 130 is tightened onto the electrical plug 114. The power cable 131 at the other end is connected to a power supply.

In step 604, power cord 141 of a device, e.g., a pool cleaner, is connected to electrical socket 124 of swivel tail 120, and the electrical connector 140 is tightened onto the electrical socket 124.

In step 606, the pool cleaner is submerged in pool water, and the swivel cord-connector 100*a* floats on the water surface.

In step 608, the pool cleaner is turned on, and consequently electricity is transmitted from the power supply to the swivel cord-connector 100*a*, and then to the pool cleaner.

In step 610, the pool cleaner moves to clean the bottom and/or sidewalls of the pool, while the power cord 141 starts twisting, transmitting a rotating force to the swivel cord-connector 100*a*.

In step 612, the asymmetrical structure of swivel head 110 provides counter torque forces to resist the rotating force and hold the swivel head 110 from rotating.

In step 1614, the swivel tail 120 rotates together with the power cord 141 of the pool cleaner to untwist the power cord 141.

In step 616, the pool cleaner is turned off and the pool cleaner and swivel cord-connector 100*a* are taken out of the pool.

In step 618, the power cord 141 of the pool cleaner is disconnected from the swivel tail 120, and the power cable 131 is disconnected from the swivel head 110.

In step 620, in case water gets into the swivel head 110, either one or both of drain ports 119*a* and 119*b* on swivel head 110 is opened to drain out the water. In some embodiments, step 620 is optional.

In an embodiment, each of the steps of method 600 is a distinct step. In another embodiment, although depicted as distinct steps in FIG. 6, step 602-620 may not be distinct steps. In other embodiments, method 600 may not have all of the above steps and/or may have other steps in addition to or instead of those listed above. The steps of method 600 may be performed in another order. Subsets of the steps listed above as part of method 600 may be used to form their own method.

Method of Making

Figure 7A:
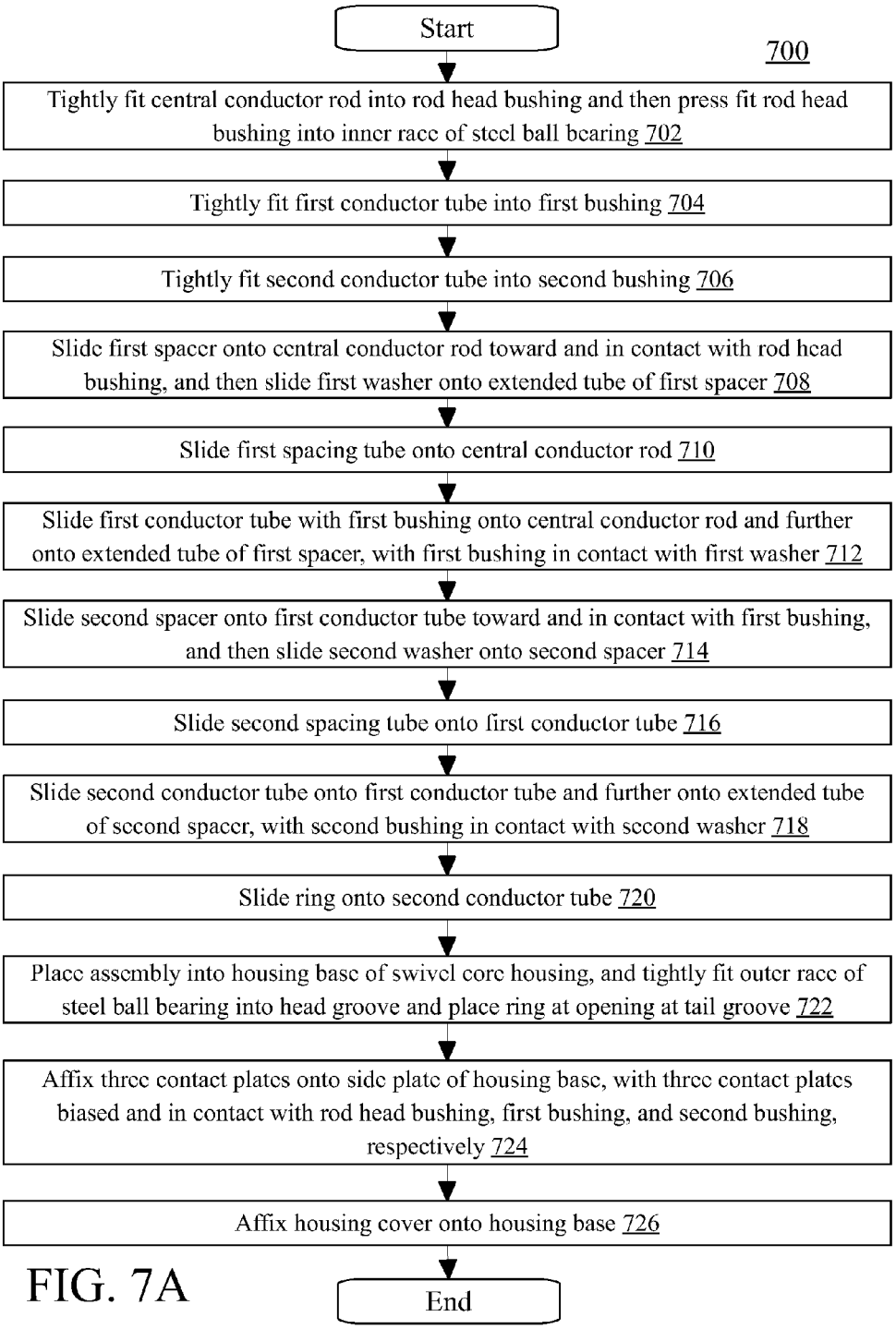
FIGS. 7A and 7B are flowcharts of an embodiment of a method of assembling a head assembly of the swivel core of FIG. 2.
Figure 7B:
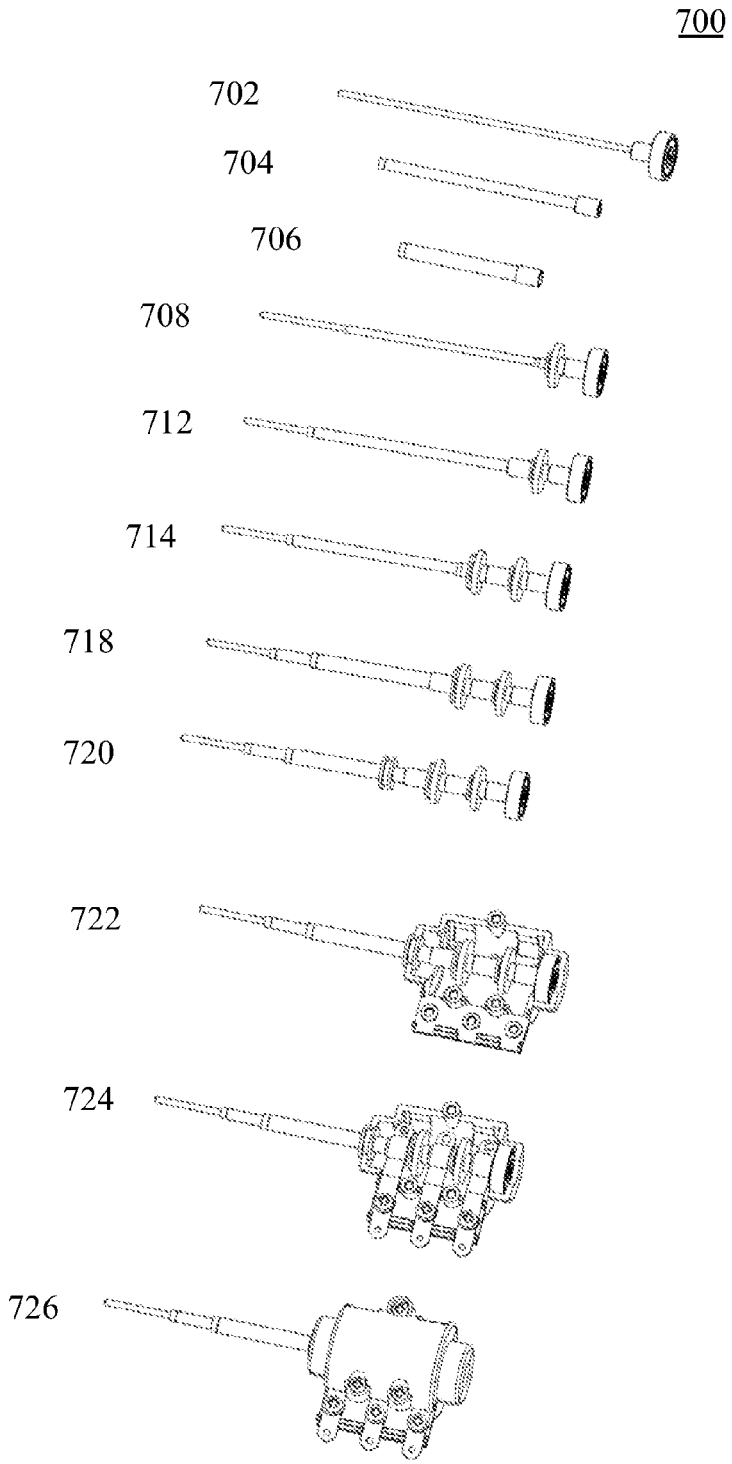

FIGS. 7A and 7B are flowcharts of an embodiment of method 700 of making the head assembly of swivel core 200.

In step 702, central conductor rod 210 is tightly fitted into rod head bushing 212*a* at bushing portion 212*b*. Connector 212*c* of rod head bushing 212*a* press fits into inner disk 213*b* of bearing 213*a*.

In step 704, first conductor tube 220 is tightly fitted into first bushing 222*a* at head end of first conductor tube 220.

In step 706, second conductor tube 230 is tightly fitted into second bushing 232*a* at head end of second conductor tube 230.

In step 708, first spacer 224*a* slides onto the central conductor rod 210 toward and in contact with the rod head bushing 212*a*, with the extended tube 225*a* of the first spacer 224*a* facing away from the rod head bushing 212*a*. Then a first washer 223*a* slides onto the extended tube 225*a* of the first spacer 224*a*.

In step 710, a first spacing tube 228 slides onto the central conductor rod 210. Step 710 is optional.

In step 712, the first conductor tube 220 with first bushing 222*a* slides onto the central conductor rod 210 and further onto extended tube 225*a* of the first spacer 224*a*, with the first bushing 222*a* being in contact with the first washer 223*a*. In one embodiment, the first spacing tube 228 is in-between the first conductor tube 220 and the central conductor rod 210.

In step 714, a second spacer 234*a* slides onto the first conductor tube 220 toward and in contact with the first bushing 222*a*, with the extended tube 235*a* of the second spacer 234*a* facing away from the first bushing 222*a*. Then a second washer 233*a* slides onto the extended tube 235*a* of the second spacer 234*a*.

In step 716, a second spacing tube 238 slides onto the first conductor tube 220. Step 716 is optional.

In step 718, the second conductor tube 230 with second bushing 232*a* slides onto the first conductor tube 220 and further onto extended tube 235*a* of the second spacer 234*a*, with the second bushing 232*a* being in contact with the second washer 233*a*. In one embodiment, the second spacing tube 238 is in-between the first conductor tube 220 and second conductor tube 230.

In step 720, ring 240 slides onto the second conductor tube 230.

In step 722, the assembly described above is placed into housing base 270 of swivel core housing 250, with outer disk 213*c* of the bearing 213*a* tightly fitted into head groove 273*a* of the housing base 270, and the groove 241 of ring 240 stuck at the opening 274*a* of housing base 270.

In step 724, three contact plates 290*a-c* are affixed, via screws 299*a-c* through each hole 295 at plate body 291, onto side plate 276 of housing base 270, each plate head 293 of the contact plates 290*a-c* being kept in contact with rod head bushing 212*a*, first bushing 222*a*, and second bushing 232*a*, respectively.

In step 726, housing cover 260 is tightly affixed onto housing base 270, to form the swivel core housing 250. Optionally, housing cover 260 and housing base 270 are connected via screws 281*a-c*, hooks 275*a* and 275*b*, and/or other fasteners.

In an embodiment, each of the steps of method 700 is a distinct step. In another embodiment, although depicted as distinct steps in FIG. 7, step 702-726 may not be distinct steps. In other embodiments, method 700 may not have all of the above steps and/or may have other steps in addition to or instead of those listed above. The steps of method 700 may be performed in another order. In fact, although component needs to be formed prior to being attached, the attaching and mounting steps could be performed in nearly any order. Subsets of the steps listed above as part of method 700 may be used to form their own method.

Figure 8A:
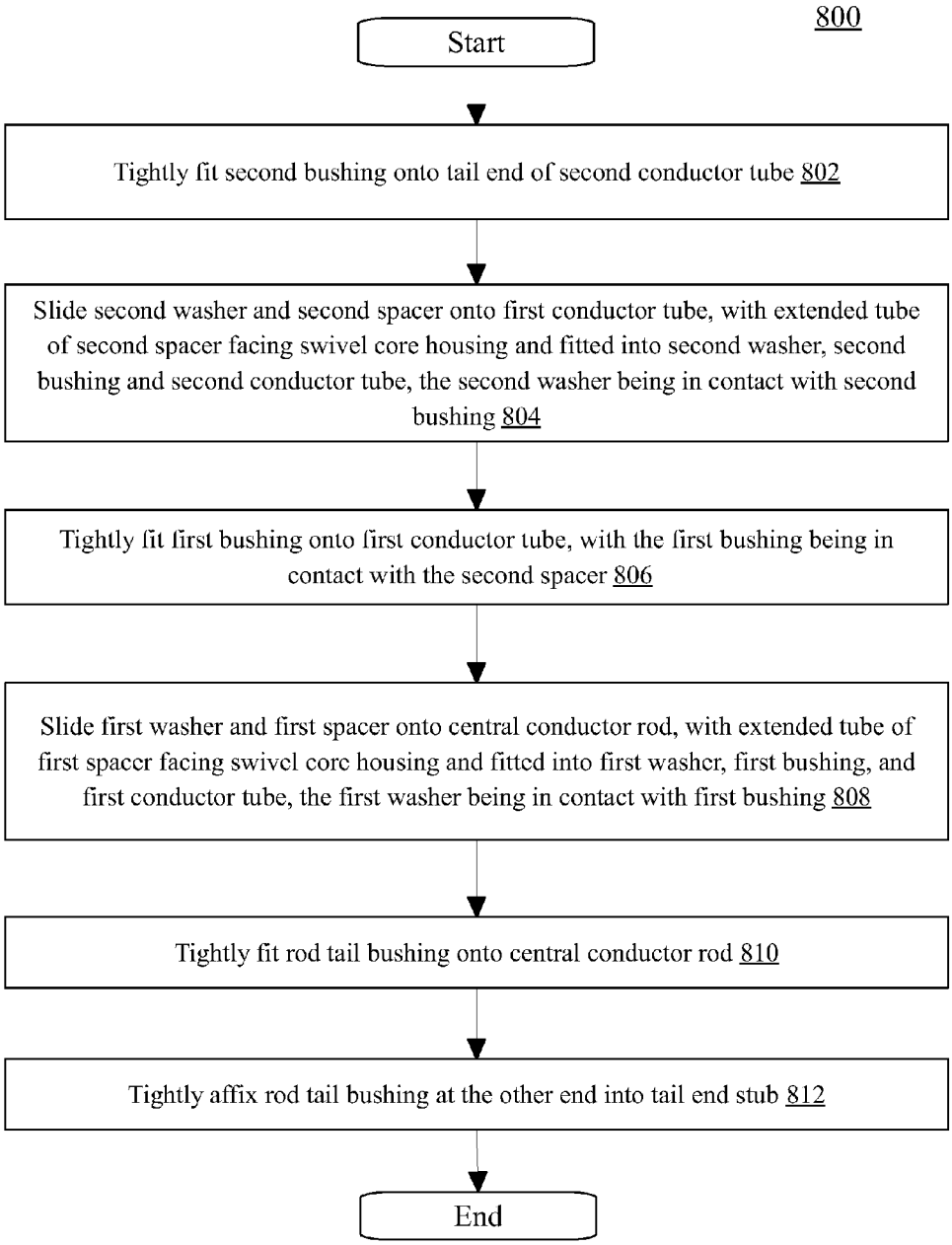
FIGS. 8A and 8B are flowcharts of an embodiment of a method of assembling a tail assembly of the swivel core of FIG. 2.
Figure 8B:
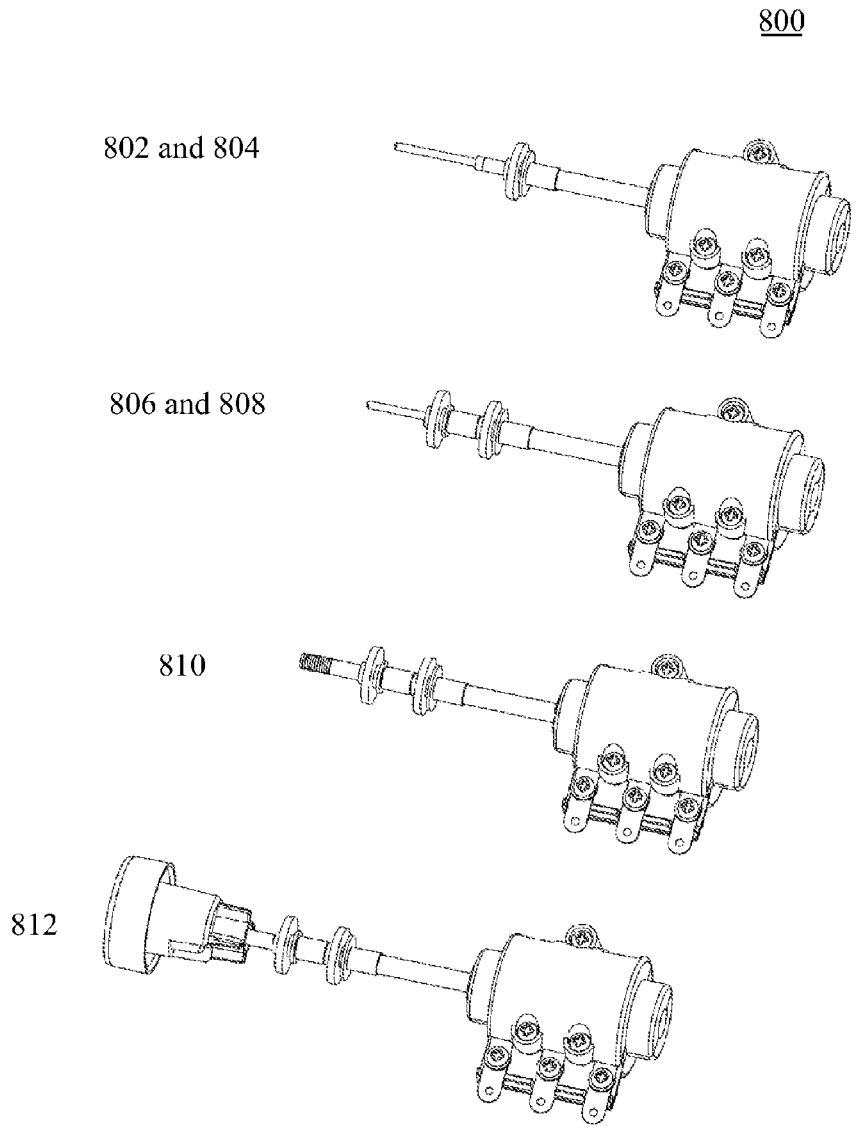

FIGS. 8A and 8B are flowcharts of an embodiment of method 800 of making the tail assembly of swivel core 200.

In step 802, second bushing 232*b* is tightly fitted onto the second conductor tube 230 at the tail end. In one embodiment, before step 802, head assembly of swivel core 200 including the swivel core housing 250 is assembled as described in FIGS. 7A and 7B. In another embodiment, the tail assembly of the swivel core 200 may be assembled first, starting from an assembly of concentric central conductor rod 210, first conductor tube 220, and second conductor tube 230.

In step 804, second washer 233*b* and second spacer 234*b* slide onto first conductor tube 220, with extended tube 235*b* of the second spacer 234*b*, facing the swivel core housing 250, fitted into second washer 233*b*, second bushing 232*b* and second conductor tube 230. The second washer 233*b* is in contact with the second bushing 232*b*.

In step 806, first bushing 222*b* is tightly fitted onto first conductor tube 220. The first bushing 222*b* is in contact with the second spacer 234*b*.

In step 808, first washer 223*b* and first spacer 224*b* slide onto central conductor rod 210, with extended tube 225*b* of first spacer 224*b*, facing the swivel core housing 250, fitted into first washer 223*b*, first bushing 222*b*, and first conductor tube 220. The first washer 223*b* is in contact with the first bushing 222*b*.

In step 810, rod tail bushing 214 is tightly fitted onto central conductor rod 210.

In step 812, the rod tail bushing 214, at the other end, is tightly affixed into hole 216 of tail end stub 215.

In an embodiment, each of the steps of method 800 is a distinct step. In another embodiment, although depicted as distinct steps in FIG. 8, step 802-812 may not be distinct steps. In other embodiments, method 800 may not have all of the above steps and/or may have other steps in addition to or instead of those listed above. The steps of method 800 may be performed in another order. In fact, although component needs to be formed prior to being attached, the attaching and mounting steps could be performed in nearly any order. Subsets of the steps listed above as part of method 800 may be used to form their own method.

Figure 9:
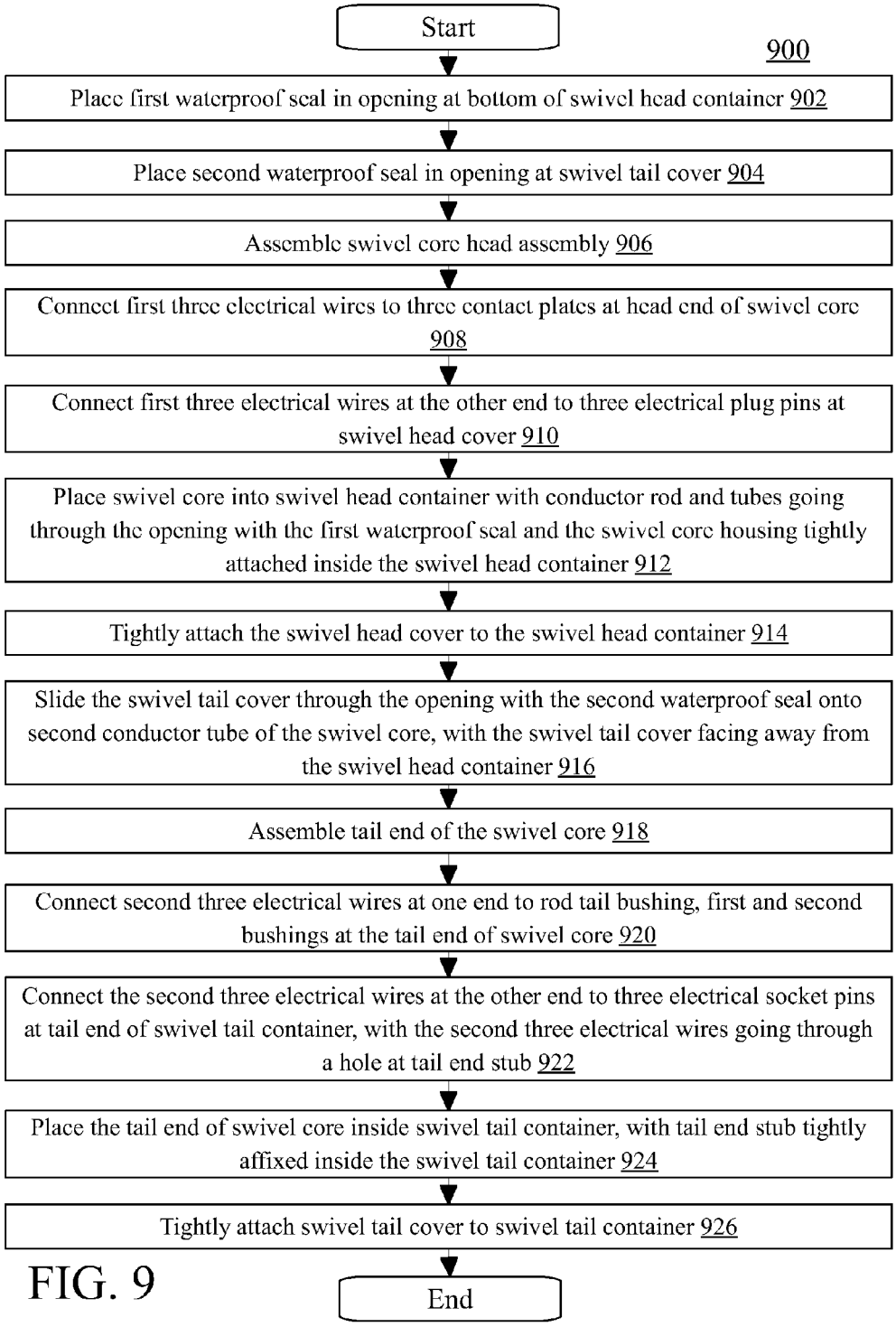
FIG. 9 is a flowchart of an embodiment of a method of assembling the swivel cord-connector of FIG. 1A.

FIG. 9 is a flowchart of an embodiment of method 900 of making the swivel cord-connector 100*a*.

In step 902, first waterproof seal 151 is placed inside opening 119.2 of swivel head container 116 for providing a watertight seal.

In step 904, second waterproof seal 152 is placed inside opening 122 at the swivel tail cover 121 for providing a watertight seal.

In step 906, swivel core head assembly 119.1 is assembled. In at least one embodiment, the swivel core head assembly 119.1 includes at least the head ends of central conductor rod 210, first conductor tube 220, and second conductor tube 230, as well as rod head bushing 212*a*, bearing 213*a*, first bushing 222*a*, first washer 223*a*, first spacer 224*a*, second bushing 232*a*, second washer 233*a*, second spacer 234*a*, ring 240, swivel core housing 250, contact plates 290*a-c*, screws 281*a-c*, and screws 299*a-c*. In one embodiment, the head assembly 119.1 is assembled using method 700 described in conjugation with FIGS. 7A and 7B. In another embodiment, the head assembly 119.1 may be assembly using other methods or in other orders.

In step 908, first three electrical wires are connected to three contact plates 290*a-c* at the head end of swivel core 200, respectively. In one embodiment, each one of the first three electrical wires is rigidly connected (e.g., soldered) to hole 294 of one of the three contact plates 290*a-c*.

In step 910, the other ends of the first three electrical wires are connected to three plug pins 115*a-c* of electrical plug 114.

In step 912, the swivel core head assembly 119.1 is placed inside swivel head container 116, with the concentric central conductor rod 210, first conductor tube 220, and second conductor tube 230 going through the opening 119.2 of swivel head container 116. The swivel core housing 250 is tightly attached inside the swivel head container 116, with the second conductor tube 230 being in contact with the first waterproof seal.

In step 914, the swivel head cover 111 is tightly attached to the swivel head container 116.

In step 916, the swivel tail cover 121 slides onto tail end of swivel core head assembly 119.1 that protrudes out of the swivel head container 116, with the swivel tail cover 121 facing away from the swivel head container 116. The second conductor tube 230 is in contact with the second waterproof seal at opening 122.

In step 918, a tail assembly of swivel core 200 is assembled. In one embodiment, the tail assembly of swivel core 200 includes at least tail ends of central conductor rod 210, first conductor tube 220, and second conductor tube 230, as well as rod tail bushing 214, tail end stub 215, first bushing 222*b*, first washer 223*b*, first spacer 224*b*, second bushing 232*b*, second washer 233*b*, and second spacer 234*b*. In one embodiment, the tail assembly of swivel core 200 is assembled using the method 800 described in conjugation with FIGS. 8A and 8B. In another embodiment, the tail assembly of swivel core 200 may be assembly using other methods or in other orders.

In step 920, electrical wires 126*a-c* are connected to rod tail bushing 214, first bushing 222*b*, and second bushing 232*b*, respectively. In one embodiment, the electrical wires 126*a-c* are rigidly connected (e.g., soldered) to the three bushings at the tail end of swivel core 200 respectively.

In step 922, the electrical wires 126*a-c* at the other end are connected to socket pins 125*a-c* of electrical socket 124 located at the bottom of swivel tail container 123, with the electrical wires 126*a-c* going through opening 217 at the tail end stub 215.

In step 924, the tail assembly of swivel core 200 is placed inside swivel tail container 123, with tail end stub 215 tightly affixed inside the swivel tail container 123.

In step 926, the swivel tail cover 121 is tightly attached to the swivel tail container 123.

In an embodiment, each of the steps of method 900 is a distinct step. In another embodiment, although depicted as distinct steps in FIG. 9, step 902-926 may not be distinct steps. In other embodiments, method 900 may not have all of the above steps and/or may have other steps in addition to or instead of those listed above. The steps of method 900 may be performed in another order. In fact, although component needs to be formed prior to being attached, the attaching and mounting steps could be performed in nearly any order. Subsets of the steps listed above as part of method 900 may be used to form their own method.

Figure 10:
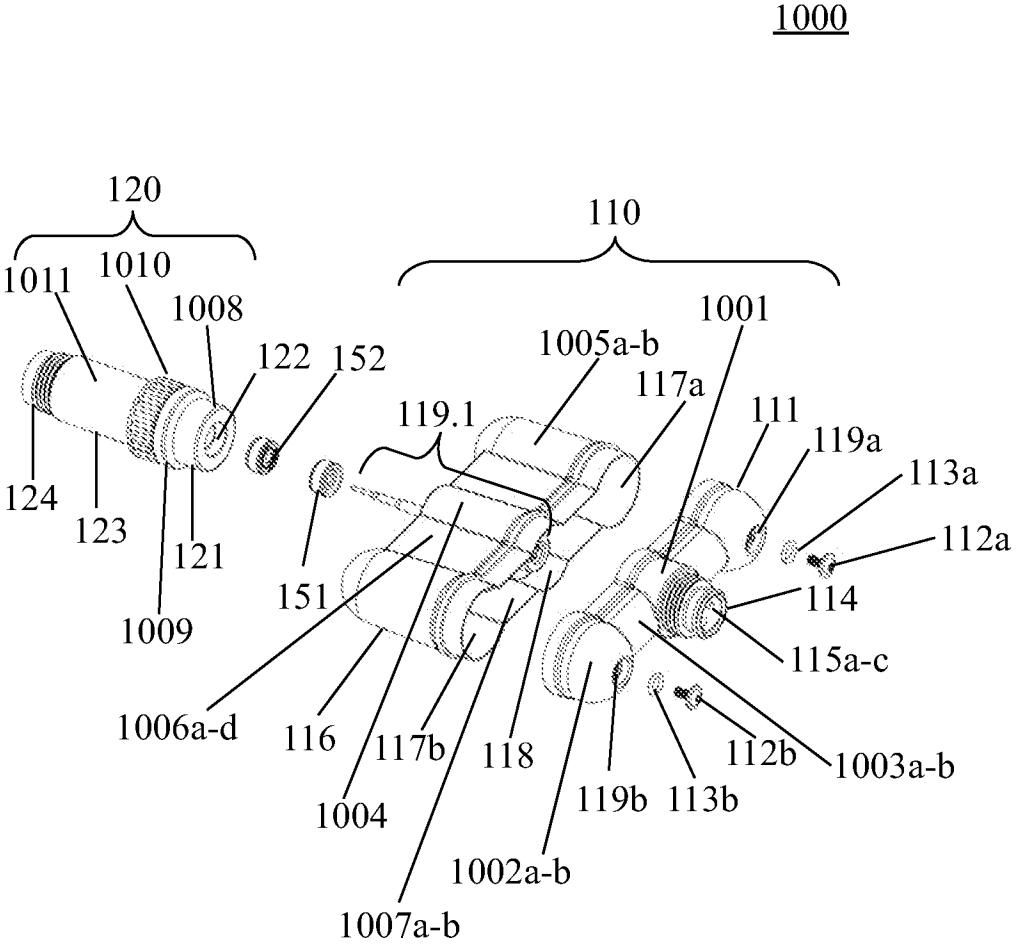
FIG. 10 shows another partially exploded view of an embodiment of FIG. 1B.

FIG. 10 shows another partial exploded view 1000 of an embodiment of FIG. 1B. FIG. 10 includes at least swivel head 110, swivel head cover 111, screws 112*a* and 112*b*, o-rings 113*a* and 113*b*, electrical plug 114, plug pins 115*a-c*, swivel head container 116, side chambers 117*a* and 117*b*, middle chamber 118, drain ports 119*a* and 119*b*, swivel core head assembly 119.1, swivel tail 120, swivel tail cover 121, opening 122, swivel tail container 123, electrical socket 124, which were discussed in conjunction with FIG. 1A. FIG. 10 also includes a top middle chamber 1001, top side chambers 1002*a-b*, connecting portions 1003*a-b*, a bottom middle chamber 1004, bottom side chambers 1005*a-b*, side walls 1006*a-d*, flat portions 1007*a-b*, a top portion 1008, a rim 1009, a grip portion 1010, and a tube portion 1011. In other embodiments, FIG. 10 may not have all of the elements or features listed and/or may have other elements or features instead of or in addition to those listed.

Top middle chamber 1001 and top side chambers 1002*a-b* are portions of middle chamber 118, side chambers 117*a* and 117*b*, respectively, which are connected via connecting portions 1003*a-b* to form the swivel head cover 111. Bottom middle chamber 1004 and bottom side chambers 1005*a-b* at the swivel head container 116 engage with top middle chamber 1001 and top side chambers 1002*a-b* to form middle chamber 118, side chambers 117*a* and 117*b*, respectively. Side walls 1006*a-d* are four plates that connect bottom middle chamber 1004 with bottom side chambers 1005*a-b*. Flat chambers 1007*a-b* are two flat chambers for connecting side chambers 117*a* and 117*b* with middle chamber 118. Swivel tail cover 121 includes top portion 1007 with rim 1008 at the opening facing the swivel tail container 123. Grip portion 1009 is at the opening of the swivel tail container 123 facing the swivel tail cover for providing a better grip. Tube portion 1010 is a tubular portion for connecting grip portion 1009 and the electrical socket 124.

Table. 1 and 2 show dimensions of an embodiment of some elements mentioned in this specification. The dimensions are shown in inches in Table. 1 and 2. It will be understood by those skilled in the art that Table. 1 and 2 show an example of the embodiments of the invention, and the invention is not limited to the example and dimensions listed in Table. 1 and 2. It should be understood that modifications may be made without departing from the essential teachings of the invention. Tables. 1 and 2 below include a tolerance of 10%. Of course, components that are intended to fit snugly within one another need to vary together so that those components still fit within one another, snugly. In other embodiments other dimensions may be used that are outside of the tolerances listed below.

TABLE 1

| | | Length | | Width | | Thickness | |
|---|---|---|---|---|---|---|---|
| Number | Element | | Tolerance | | Tolerance | | Tolerance |
| 110 | swivel head | | | 6 | 0.6 | | |
| 117a-b | side chambers | 4.12 | 0.412 | | | | |
| 118 | middle chamber | 4.12 | 0.412 | | | | |
| 1007a-b | flat chambers | 3.5 | 0.35 | 1.13 | 0.113 | 0.87 | 0.087 |
| 111 | swivel head cover | | | 6 | 0.6 | | |
| 1001 | top middle chamber | 1.06 | 0.106 | | | | |
| 1002a-b | top side chambers | 1.25 | 0.125 | | | | |
| 1003a-b | connecting portions | 1 | 0.1 | 1.06 | 0.106 | 1.06 | 0.106 |
| 116 | swivel head container | | | 6 | 0.6 | | |
| 1004 | bottom middle chamber | 2.69 | 0.269 | | | | |
| 1005a-b | bottom side chambers | 3.13 | 0.313 | | | | |
| 1006a-d | side walls | 2.69 | 0.269 | 1.12 | 0.112 | 0.03 | 0.003 |
| 114 | electrical plug | 0.81 | 0.081 | | | | |
| 115a-c | plug pins | 0.81 | 0.081 | | | | |
| 119.1 | swivel core head assembly | 4.75 | 0.475 | | | | |
| 119a-b | drain ports | 0.25 | 0.025 | | | | |
| 119.2 | opening | 0.37 | 0.037 | | | | |

TABLE 1-continued

| Number | Element | Length | Tolerance | Width | Tolerance | Thickness | Tolerance |
|---|---|---|---|---|---|---|---|
| 120 | swivel tail | 4.13 | 0.413 | | | | |
| 121 | swivel tail cap | 0.88 | 0.088 | | | | |
| 1008 | top portion | 0.5 | 0.05 | | | | |
| 1009 | rim | 0.37 | 0.037 | | | | |
| 122 | opening | 0.37 | 0.037 | | | | |
| 123 | swivel tail container | 3.5 | 0.35 | | | | |
| 1010 | grip portion | 0.81 | 0.081 | | | | |
| 1011 | tube portion | 1.94 | 0.194 | | | | |
| 124 | electrical socket | 0.69 | 0.069 | | | | |
| 125a-c | socket pins | 0.81 | 0.081 | | | | |
| 151 | waterproof seal | 0.314 | 0.0314 | | | | |
| 152 | waterproof seal | 0.314 | 0.0314 | | | | |
| 210 | central conductor rod | 4.2 | 0.42 | | | | |
| 212a | rod head bushing | 0.47 | 0.047 | | | | |
| 212b | bushing portion | 0.27 | 0.027 | | | | |
| 212c | connector | 0.2 | 0.02 | | | | |
| 213a | bearing | | | | | 0.197 | 0.0197 |
| 213b | inner disk | | | | | 0.195 | 0.0195 |
| 213c | outer disk | | | | | 0.197 | 0.0197 |
| 214 | rod tail bushing | 0.625 | 0.0625 | | | | |
| 215 | tail end stub | 1.375 | 0.1375 | | | | |
| 217 | hole | 0.3 | 0.03 | 0.25 | 0.025 | | |
| 218a-n | flange | 0.34 | 0.034 | 0.125 | 0.0125 | 0.03 | 0.003 |
| 219 | base | | | | | 0.44 | 0.044 |
| 220 | first conductor tube | 3.06 | 0.306 | | | | |
| 222a-b | first bushing | 0.3 | 0.03 | | | | |
| 223a-b | first washer | | | | | 0.03 | 0.003 |
| 224a-b | first spacer | 0.41 | 0.041 | | | | |
| 225a-b | extended tube | 0.25 | 0.025 | | | | |
| 228 | first spacing tube | 3 | 0.3 | | | | |
| 230 | second conductor tube | 1.87 | 0.187 | | | | |
| 232a-b | second bushing | 0.28 | 0.028 | | | | |
| 233a-b | second washer | | | | | 0.03 | 0.003 |
| 234a-b | second spacer | 0.39 | 0.039 | | | | |
| 235a-b | extended tube | 0.25 | 0.025 | | | | |
| 238 | second spacing tube | 1.7 | 0.17 | | | | |
| 240 | ring | | | | | 0.16 | 0.016 |
| 241 | groove | | | | | 0.08 | 0.008 |
| 250 | swivel core housing | 1.94 | 0.194 | | | | |
| 260 | housing cover | 1.94 | 0.194 | | | | |
| 263a | head chamber | 0.28 | 0.028 | | | | |
| 263b | tail chamber | 0.28 | 0.028 | | | | |
| 263c | middle chamber | 1.38 | 0.138 | | | | |
| 262 | guiding tube | 0.33 | 0.033 | | | | |
| 265a-b | tabs | 0.62 | 0.062 | 0.25 | 0.025 | 0.06 | 0.006 |
| 270 | housing base | 1.94 | 0.194 | | | | |
| 271 | poles | 0.31 | 0.031 | | | | |
| 272 | pole | 0.37 | 0.037 | | | | |
| 273a | head chamber | 0.28 | 0.028 | | | | |
| 273b | tail chamber | 0.28 | 0.028 | | | | |
| 273c | middle chamber | 1.38 | 0.138 | | | | |
| 275a-b | tab slots | 0.37 | 0.037 | 0.28 | 0.028 | | |
| 276 | side plate | 1.38 | 0.138 | 0.25 | 0.025 | 0.06 | 0.006 |
| 290a-c | contacting plates | 1.56 | 0.156 | 0.22 | 0.022 | 0.01 | 0.001 |
| 291 | plate body | 0.69 | 0.069 | 0.22 | 0.022 | 0.01 | 0.001 |
| 292 | plate neck | 0.34 | 0.034 | 0.22 | 0.022 | 0.01 | 0.001 |
| 293 | plate head | 0.53 | 0.053 | 0.22 | 0.022 | 0.01 | 0.001 |
| 301 | waterproof seal | | | | | 0.25 | 0.025 |
| 411 | swivel head cover | 1.87 | 0.187 | | | | |
| 416 | swivel head container | 2.68 | 0.268 | | | | |
| 430 | swivel head | 2.87 | 0.287 | | | 1.25 | 0.125 |
| 431 | top base | | | 5 | 0.5 | | |
| 432 | bottom base | | | 2.56 | 0.256 | | |

TABLE 2

| Number | Element | Outer diameter | Tolerance | Inner diameter | Tolerance |
|---|---|---|---|---|---|
| 117a-b | side chambers | 1.45 | 0.145 | 1.41 | 0.141 |
| 118 | middle chamber | 1.3 | 0.13 | 1.28 | 0.128 |

TABLE 2-continued

| Number | Element | Outer diameter | Tolerance | Inner diameter | Tolerance |
|---|---|---|---|---|---|
| 1001 | top middle chamber | 1.5 | 0.15 | 1.44 | 0.144 |

TABLE 2-continued

| Number | Element | Outer diameter | Tolerance | Inner diameter | Tolerance |
|---|---|---|---|---|---|
| 1002a-b | top side chambers | 1.62 | 0.162 | 1.3 | 0.13 |
| 1004 | bottom middle chamber | 1.27 | 0.127 | 1.25 | 0.125 |
| 1005a-b | bottom side chambers | 1.45 | 0.145 | 1.42 | 0.142 |
| 114 | electrical plug | 1 | 0.1 | | |
| 119a-b | drain ports | 0.53 | 0.053 | 0.1 | 0.01 |
| 119.2 | opening | 1.06 | 0.106 | 0.53 | 0.053 |
| 1008 | top portion | 1.25 | 0.125 | | |
| 1009 | rim | 1.56 | 0.156 | | |
| 122 | opening | 0.68 | 0.068 | 0.2 | 0.02 |
| 1010 | grip portion | 1.52 | 0.152 | | |
| 1011 | tube portion | 1.24 | 0.124 | | |
| 124 | electrical socket | 1.22 | 0.122 | | |
| 151 | waterproof seal | 0.66 | 0.066 | 0.18 | 0.018 |
| 152 | waterproof seal | 0.66 | 0.066 | 0.18 | 0.018 |
| 210 | central conductor rod | 0.06 | 0.006 | | |
| 212b | bushing portion | 0.233 | 0.0233 | 0.05 | 0.005 |
| 212c | connector | 0.223 | 0.0223 | 0.05 | 0.005 |
| 213a | bearing | 0.63 | 0.063 | 0.214 | 0.0214 |
| 213b | inner disk | 0.334 | 0.0334 | 0.214 | 0.0214 |
| 213c | outer disk | 0.63 | 0.063 | 0.53 | 0.053 |
| 214 | rod tail bushing | 0.164 | 0.0164 | 0.06 | 0.006 |
| 216 | hole | 0.31 | 0.031 | 0.16 | 0.016 |
| 219 | base | 1.125 | 0.1125 | 0.63 | 0.063 |
| 220 | first conductor tube | 0.125 | 0.0125 | 0.11 | 0.011 |
| 222a-b | first bushing | 0.233 | 0.0233 | 0.125 | 0.0125 |
| 223a-b | first washer | 0.32 | 0.032 | 0.14 | 0.014 |
| 224a-b | first spacer | 0.58 | 0.058 | 0.08 | 0.008 |
| 225a-b | extended tube | 0.1 | 0.01 | 0.08 | 0.008 |
| 228 | first spacing tube | 0.09 | 0.009 | 0.07 | 0.007 |
| 230 | second conductor tube | 0.2 | 0.02 | 0.18 | 0.018 |
| 232a-b | second bushing | 0.233 | 0.0233 | 0.2 | 0.02 |
| 233a-b | second washer | 0.47 | 0.047 | 0.21 | 0.021 |
| 234a-b | second spacer | 0.58 | 0.058 | 0.14 | 0.014 |
| 235a-b | extended tube | 0.17 | 0.017 | 0.14 | 0.014 |
| 238 | second spacing tube | 0.16 | 0.016 | 0.14 | 0.014 |
| 240 | ring | 0.43 | 0.043 | 0.19 | 0.019 |
| 241 | groove | 0.43 | 0.043 | 0.33 | 0.033 |
| 242 | hole | | | 0.19 | 0.019 |
| 263a | head chamber | 0.78 | 0.078 | 0.63 | 0.063 |
| 263b | tail chamber | 0.78 | 0.078 | 0.63 | 0.063 |
| 263c | middle chamber | 1.25 | 0.125 | 1 | 0.1 |
| 262 | guiding tube | 0.34 | 0.034 | 0.25 | 0.025 |
| 264a and 264c | openings | | | 0.3 | 0.03 |
| 264b and 274d | openings | | | 0.5 | 0.05 |
| 272 | pole | 0.2 | 0.02 | | |
| 273a | head chamber | 0.78 | 0.078 | 0.63 | 0.063 |
| 273b | tail chamber | 0.78 | 0.078 | 0.63 | 0.063 |
| 273c | middle chamber | 1.25 | 0.125 | 1 | 0.1 |
| 274a and 274c | openings | | | 0.3 | 0.03 |
| 274b and 274d | openings | | | 0.5 | 0.05 |
| 293 | plate head | 0.34 | 0.034 | | |
| 294 | hole | | | 0.07 | 0.007 |
| 295 | hole | | | 0.14 | 0.014 |
| 295 | hole | | | 0.11 | 0.011 |
| 301 | waterproof seal | 1 | 0.1 | 0.65 | 0.065 |
| 411 | swivel head cover | 1.5 | 0.15 | | |
| 416 | swivel head container | 1.5 | 0.15 | | |

Alternatives and Extensions

Each embodiment disclosed herein may be used or otherwise combined with any of the other embodiments disclosed. Any element of any embodiment may be used in any embodiment.

Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention. Although the invention has been described with reference to specific embodiments, it will be understood by those skilled in the art that various changes may be made and equivalents may be substituted for elements thereof without departing from the true spirit and scope of the invention. In addition, modifications may be made without departing from the essential teachings of the invention.

The invention claimed is:

1. A system comprising a cord-connector including at least:

a head having a noncircular cross section;

a tail having a symmetrical structure, the tail being able to rotate with respect to the head, with friction between the tail and the head creating a torque, as the tail rotates, the torque impeding rotation of the tail with respect to the head and pushing the head to rotate with the tail;

a core that electrically connects the head and the tail and maintains continuity of electricity when the tail rotates; and wherein the head is electrically connectable to a first power cord that is flexible, the first power cord carrying electricity into the head, wherein the tail is electrically connectable to a second power cord that is flexible, the second power cord carrying electricity out of the tail;

wherein the noncircular cross section is a cross section on a plane cut through the head, the plane being perpendicular to an axis running along a length of the head from a connection on the head, via the core, to the tail to a location on the head where the head is connectable to the first power cord;

wherein when the head rests on a surface, the noncircular cross section hindering the head from rotating with the tail, by the noncircular cross section of the head creating a counter torque that balances the torque that is created by the friction between the tail and head, the counter torque preventing rotation of the head with the tail despite the torque created by the friction, so that the tail rotates without the head rotating.

2. The system of claim 1, wherein the head has a double-barrel wing.

3. The system of claim 1, wherein the head has a delta wing.

4. The system of claim 1, wherein the head, having the noncylindrical structure, is detachable from the first power cord.

5. The system of claim 1, wherein the system is waterproof.

6. The system of claim 5, wherein an average density of the system is less than the density of water.

7. The system of claim 1, wherein the tail being one of more than one tails;

the second power cord being one of more than one power cords;

the core being one of more than one cores; and wherein the more than one cores electrically connect the more than one tails to the head, wherein the more than one tails rotate with respect to the head, wherein the more than one power cords carry electricity out of the more than one tails.

8. A system comprising at least:

a head having a noncylindrical cross section that creates sufficient counter torque when the head is laid on a surface to prevent the head from spinning, as a result of a power cord rotating that is connected to the head;

a tail having a symmetrical structure, the tail being able to rotate with respect to the head;

a core for electrically connecting the head and the tail and maintaining continuity of electricity when the tail is rotating; and wherein the head is electrically connected to a first power cord, the first power cord carrying electricity into the head, wherein the tail is electrically connected to a second power cord, the second power cord carrying electricity out of the tail, further comprising at least a central conductor rod having a head end and a tail end;

a first conductor tube having a head end and a tail end;

a second conductor tube having a head end and a tail end;

a head assembly of a core being enclosed in the head, the head assembly including at least a rod head bushing being connected to the head end of the central conductor rod for transmitting electricity while reducing contact resistance;

a bearing having an inner disk and an outer disk, the inner disk being connected to the rod head bushing, wherein the inner disk rotates with respect to the outer disk;

a first bushing being connected to the head end of the first conductor tube;

a second bushing being connected to the head end of the second conductor tube;

a first spacer being placed between the rod head bushing and the first bushing for blocking transmission of electricity;

a second spacer being placed between the first bushing and the second bushing for blocking transmission of electricity;

a core housing for enclosing at least the head ends of central conductor rod, first conductor tube, and second conductor tube, and the rod head bushing, the first bushing, the second bushing, the first spacer, and the second spacer, wherein the outer disk of the bearing is tightly attached in the core housing, wherein the core housing is tightly affixed in the head;

three contact plates for maintaining continuity of electricity, the three contact plates being affixed to the core housing and kept in contact with the rod head bushing, the first bushing, and the second bushing, respectively;

a tail assembly of the core being enclosed in the tail, the tail assembly including at least a rod tail bushing being connected to the tail end of the central conductor rod, wherein the rod tail bushing connects the central conductor rod to a tail end stub, the tail end stub being tightly affixed in the tail;

a third bushing being connected to the tail end of the second conductor tube;

a fourth bushing being connected to the tail end of the first conductor tube;

a third spacer being placed between the third bushing and the fourth bushing for blocking transmission of electricity;

a fourth spacer being placed between the fourth bushing and the rod tail bushing for blocking transmission of electricity;

and wherein the central conductor rod, the first conductor tube, and the second conductor tube are concentric, wherein the head includes a first electrical connector being connected to the three contact plates, wherein the tail includes a second electrical connector being connected to the rod tail bushing, the third bushing, and the fourth bushing.

9. The system of claim 8, further comprising a first waterproof seal in an opening at the head;

a second waterproof seal in an opening at the tail; and wherein the core goes through the opening at the head and the opening at the tail.

10. The system of claim 8, further comprising at least one drain port on head for draining water out of the head.

11. The system of claim 8, further comprising at least two spacing tubes made of one or more non-conductive materials, one of the at least two spacing tubes separates the central conductor rod and the first conductor tube, and another one of the at least two spacing tubes separates the first conductor tube and second conductor tube.

12. The system of claim 8, further comprising a plurality of washers for distributing loads, being placed between the first bushing and the first spacer, the second bushing and the second spacer, the third bushing and the third spacer, and the fourth bushing and the fourth spacer.

13. The system of claim 8, wherein the bearing is a deep-groove bearing for accommodating radial and axial loads in both directions.

14. A method for assembling a system, the system including at least, a head having a noncylindrical cross section that creates sufficient counter torque when the head is laid on a surface to prevent the head from spinning, as a result of a power cord rotating that is connected to the head;

a tail having a symmetrical structure, the tail being able to rotate with respect to the head;

a core for electrically connecting the head and the tail and maintaining continuity of electricity when the tail is rotating; and wherein the head is electrically connected to a first power cord, the first power cord carrying electricity into the head, wherein the tail is electrically connected to a second power cord, the second power cord carrying electricity out of the tail;

the method comprising at least assembling a head assembly of a core, including:

fitting a central conductor rod into a rod head bushing and connecting the rod head bushing to an inner disk of a bearing;

fitting a first conductor tube into a first bushing;

fitting a second conductor tube into a second bushing;

sliding a first spacer onto the central conductor rod and in contact with the rod head bushing;

sliding the first conductor tube with the first bushing onto the central conductor rod, the first bushing being in contact with the first spacer;

sliding a second spacer onto the first conductor tube and in contact with the first bushing;

sliding the second conductor tube with the second bushing onto the first conductor tube, the second bushing being in contact with the second spacer;

tightly fitting an outer disk of the bearing in a core housing, with the rod head bushing, the first bushing, the second bushing, the first spacer, and the second spacer in the core housing;

affixing three contact plates to the core housing, the three contact plates being kept in contact with the rod head bushing, the first bushing, and the second bushing, respectively;

connecting first three electrical wires at one ends to the three contact plates;

connecting the first three electrical wires at the other end to three electrical plug pins at a head cover;

placing the head assembly of the core into a head container, the core going through an opening at the bottom of the head container;

attaching the head cover to the head container;

sliding a tail cover onto the core through an opening at the tail cover;

assembling a tail assembly of the core, including fitting a third bushing onto the second conductor tube;

sliding a third spacer onto the first conductor tube;

fitting a fourth bushing onto the first conductor tube;

sliding a fourth spacer onto the central conductor rod;

fitting a rod tail bushing onto the central conductor rod;

fitting a tail end stub onto the rod tail bushing;

connecting second three electrical wires at one end to the tail assembly of the core;

connecting the second three electrical wires at the other end to three electrical socket pins at a tail container;

placing the tail assembly of the core into the tail container, the tail end of the core being affixed to the tail container; and attaching the tail cover to the tail container.

15. A system comprising at least:

a head being connected to a tail via a core, the tail being able to rotate with respect to the head;

the core including at least a central conductor rod having a head end and a tail end;

one or more conductor tubes being concentric to the central conductor rod, each of the one or more conductor tubes having a head end and a tail end;

a rod head bushing being connected to the head end of the central conductor rod for transmitting electricity;

a bearing having an inner disk and an outer disk, the inner disk being connected to the rod head bushing, wherein the inner disk can rotate with respect to the outer disk;

one or more bushings for transmitting electricity, each of the one or more bushings being connected to the head end of one of the one or more conductor tubes;

one or more spacers for blocking transmission of electricity, each of the one or more spacers being placed between the rod head bushing and the one or more bushings;

a core housing for enclosing at least the rod head bushing, the bearing, the one or more bushings, and the one or more spacers, wherein the outer disk of the bearing is tightly attached to the core housing;

a plurality of contact plates for maintaining continuity of electricity, each of the contact plates being affixed to the core housing and kept in contact with one of the rod head bushing and the one or more bushings; and wherein the core housing is affixed in the head, wherein the tail end of central conductor rod is affixed in the tail, wherein the central conductor rod, and the one or more conductor tubes are separated from contacting each other.

16. The system of claim 15, wherein the head has an asymmetrical structure.

17. The system of claim 15, wherein the system is waterproof and can float on water surface.

18. The system of claim 15, wherein the tail being one of one or more tails;

the core being one of one or more cores; and wherein the one or more cores electrically connect the one or more tails to the head, wherein the one or more tails rotate with respect to the head.

19. A method comprising:

detachably connecting one end of a first electrical cord to a first electrical connector located at a first end of a head of a cord-connector, and connecting another end of the first electrical cord to a power source, wherein a second end of the head is connected to the remaining parts of the cord-connector, wherein the head being noncylindrical, the head having a noncircular cross section in a plane being perpendicular to a direction that is parallel to a direction running along a length of the head from the first end of the head to the second end of the head;

detachably connecting a second electrical cord from a device to a second electrical connector at a tail of the cord-connector;

placing the cord-connector on a surface;

turning on the device, transmitting electricity from the power source to the device, operating the device, therein causing the second electrical cord to rotate; and as a result of the second electrical cord rotating, the tail rotating with the second electrical cord, as a result of friction the rotating of the tail creating a torque pushing the head to rotate in a direction of rotation of the tail, wherein the noncylindrical shape of the head hindering the head from rotating with the tail as a result of the head resting on the surface, as a result of the head resting on the surface the noncylindrical shape creating a counter torque that balances the torque that is created by the friction between the tail and head, preventing the rotation of the head with the tail, despite the torque from the friction, so that the tail rotates without the head, therein limiting a degree to which the second electrical cord twists.

20. The method of claim 19, the surface being a surface of a body of water, the placing of the cord-connector on the surface further comprising putting the cord-connector in water with the cord connector floating on the surface of the body of water.

21. The system of claim 1, the head including a wing that has the noncircular cross section and creates the counter torque.

22. The system of claim 21, the head having a central portion and the wing extending away from the central portion through which the axis runs.

23. The system of claim 22, the wing including two cylindrical structures that are not part of the central portion.

24. The system of claim 1, the head comprising electrical connections that only maintain electrical continuity from the connection to the first power cord to connection on the head, via the core to the tail.

25. The system of claim 1, the head having a noncylindrical shape.

26. A system comprising a cord-connector including at least:

a head having a noncircular cross section;

a tail, the tail being able to rotate with respect to the head, with friction between the tail and the head creating a torque, as the tail rotates, the torque impeding rotation of the tail with respect to the head and pushing the head to rotate with the tail;

a core that electrically connects the head and the tail and maintains continuity of electricity when the tail is rotated; and wherein the head is electrically connectable to a first power cord that is flexible, the first power cord carrying electricity into the head, wherein the tail is electrically connectable to a second power cord that is flexible, the second power cord carrying electricity out of the tail;

wherein the noncircular cross section is a cross section on a plane cut through the head, the plane being perpendicular to an axis running a long a length of the head from a connection on the head, via the core, to the tail to a location on the head where the head is connectable to the first power cord;

wherein when the head rests on a surface, the noncircular cross section hindering the head from rotating with the tail, by the noncircular cross section of the head creating a counter torque that balances the torque that is created by the friction between the tail and head, the counter torque preventing rotation of the head with the tail despite the torque created by the friction, so that the tail rotates without the head rotating.

* * * * *